US011161644B2

(12) United States Patent
Moss

(10) Patent No.: US 11,161,644 B2
(45) Date of Patent: Nov. 2, 2021

(54) MODULAR STACKABLE MERCHANDISE TRAYS

(71) Applicant: Geoffrey Alan Moss, Maple (CA)

(72) Inventor: Geoffrey Alan Moss, Maple (CA)

( * ) Notice: Subject to any disclaimer, the term of this patent is extended or adjusted under 35 U.S.C. 154(b) by 253 days.

(21) Appl. No.: 16/501,846

(22) Filed: Jun. 19, 2019

(65) Prior Publication Data

US 2020/0399013 A1 Dec. 24, 2020

(51) Int. Cl.

| | |
|---|---|
| ***B65D 5/00*** | (2006.01) |
| ***B65D 5/22*** | (2006.01) |
| ***B65D 21/02*** | (2006.01) |
| ***B65D 5/30*** | (2006.01) |

(52) U.S. Cl.

CPC ..... *B65D 5/0035* (2013.01); *B65D 5/22* (2013.01); *B65D 5/305* (2013.01); *B65D 21/0212* (2013.01)

(58) Field of Classification Search

CPC .. B65D 5/0035; B65D 5/0025; B65D 5/0075; B65D 5/001; B65D 5/0015; B65D 5/445; B65D 5/5028; B65D 5/5033

See application file for complete search history.

(56) References Cited

U.S. PATENT DOCUMENTS

| | | | | |
|---|---|---|---|---|
| 3,820,706 A * | 6/1974 | Watkins | B65D 5/0035 206/509 |
| 4,807,756 A * | 2/1989 | Young | B65D 5/0055 206/509 |
| 6,138,904 A * | 10/2000 | Baird | B65D 5/0075 229/122.24 |
| 6,712,214 B1 * | 3/2004 | Wintermute | B65D 5/003 206/509 |

* cited by examiner

*Primary Examiner* — Andrew T Kirsch
(74) *Attorney, Agent, or Firm* — David W. Wong

(57) ABSTRACT

A stackable merchandise tray is formed in a modular fashion with a rectangular base casing having a selected width and two identical insert units are mounted within the left and right sides of the base casing. The tray has two horizontal U-shaped upstanding mounting tabs located at the top edge of each of its two side panels and four complementary rectangular mounting openings formed adjacent to the lower lateral edges of its bottom panel. A reinforcing tab extend juxtapose to a side of each of the U-shaped upstanding mounting tabs to provide additional strength in resisting external lateral force exert on a plurality of the trays stacked together.

14 Claims, 22 Drawing Sheets

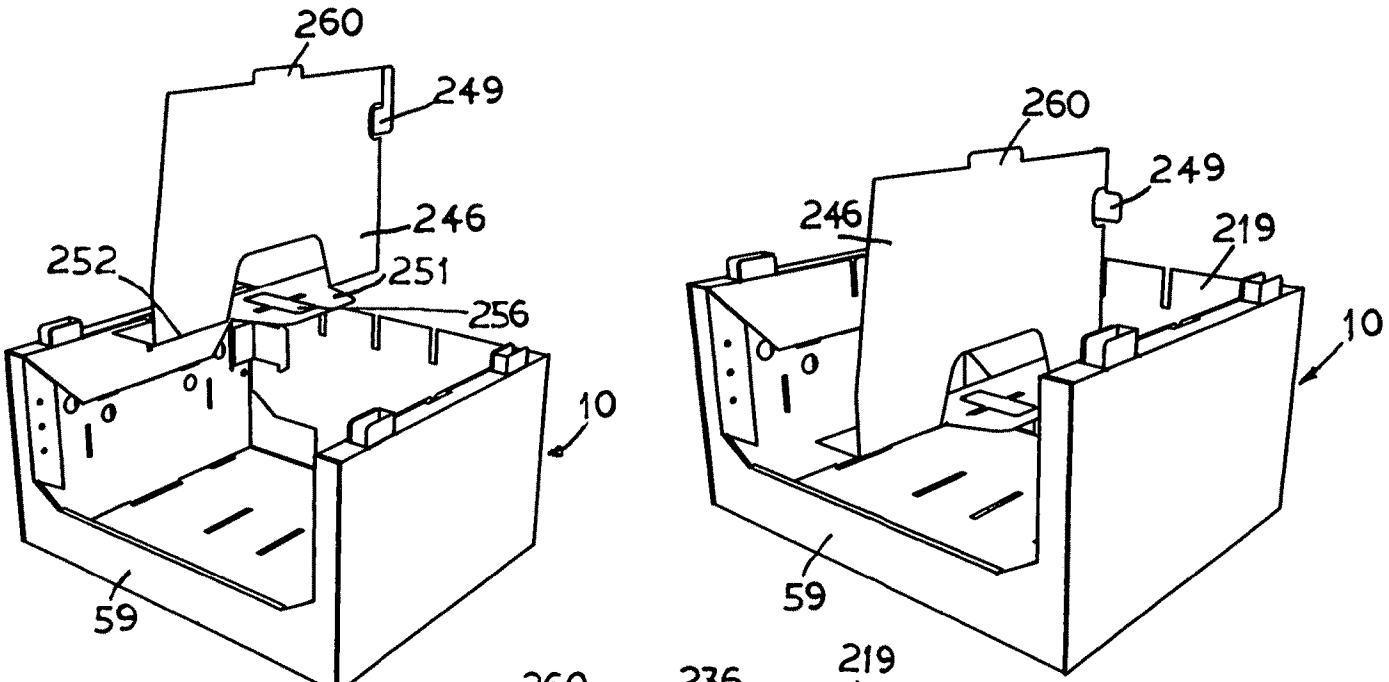
FIGURE 29A
FIGURE 29B
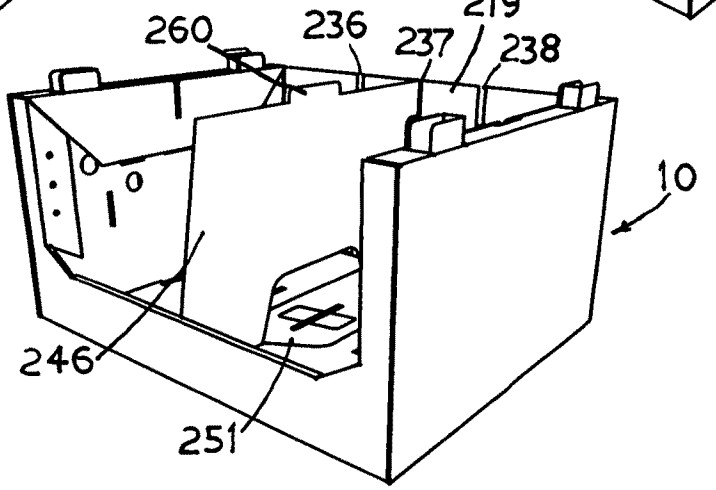
FIGURE 29C

MODULAR STACKABLE MERCHANDISE TRAYS

FIELD OF THE INVENTION

This invention relates to stackable trays for transporting, displaying and storing merchandise in which trays or various sizes are fabricated with a universal lateral insert unit for forming both the left and right lateral sides and secured to base units of trays of various widths.

BACKGROUND ART

Merchandise trays can be provided for both the purposes of transporting merchandise and displaying them readily at a sale location as well as for storage of the merchandise. Such trays greatly reduce the time and labor otherwise required of having to remove the merchandise from transporting containers and to place them on display shelves or showcases for sale and to remove them from the display again to place them in containers for storage. Similar to transporting containers, such merchandise trays are commonly made of cardboard or corrugated cardboard material. A blank of the tray pattern in a single piece of cardboard blank is stamped from a corrugated board. The pattern has various panels which may be folded along fold and scored lines to form a rectangular tray. The panels have mounting tabs which are secured together with adhesive.

Also to facilitate stacking of the trays securely together, upstanding tabs are provided commonly at the four corners of the upper edge of the trays. The tabs located at the four corners of the tray located at the bottom of a stack will engage with complementary openings formed at the four corners of the bottom of the tray located on top of the stack so as to mount the trays securely together.

Such tray is fabricated from a cardboard blank having a geometric pattern representing the outline of the tray imprinted and stamped thereon. A large number of blanks of such trays may be conveniently shipped to the manufacturer of the merchandise for readily assembling them to trays for shipping merchandise to sale locations.

Such merchandise tray is shown in U.S. Pat. No. 8,640,871 issued to the applicant of the present patent application on Feb. 4, 2014. A drawback of such tray fabricated with a one piece blank construction, is that, due to the large number of panels required in the pattern for forming the tray, the blank is very long and usually has a length well over 100 inches long; whereas transport trucks are 96 inches wide. Thus, a stack of a plurality of blanks of such tray must be loaded and unloaded from the transport truck from the short end of the transport skid which requires the use of ring tow motor and extension forks on a loading vehicle. This leads to expensive shipping cost and accidental damages to the blanks in manipulating the stack of large blanks into the restricted space within the transport truck.

Furthermore, as corrugators, the machines that fabricate the corrugated blank, have limited sizes, such as 86 or 92 inches wide whereas the blank of the tray is over 100 inches long, it is therefore necessary to feed the corrugated board into the corrugator in the manner that the flutes in the corrugated panels for subsequently forming the sides of the tray would be orientated in the horizontal direction of the side panels of the tray. Such orientation of the flutes in the tray side panels renders the side panels of the tray to have low strength to resist external forces impose on the tray, particularly when a plurality of trays loaded with merchandise are stacked together.

SUMMARY OF THE INVENTION

It is a principal object of the present invention to provide merchandise trays having rugged strength to support the weight of the merchandise and can withstand external forces exerting thereon.

It is another object of the present invention to provide merchandise trays of various sizes in a modular construction having universal side insert units mounted in base units of various selected widths.

It is another object of the present invention to provide merchandise trays in which all component parts can be formed with corrugated cardboard with flutes of all lateral sides panels orientated in the vertical direction to provide high resistance to impact forces imposed on the tray.

It is yet another object of the present invention to provide merchandise trays with all components made with corrugated board blanks of less than 100 inches long.

It is still another object of the present invention to provide merchandise tray having upstanding horizontal U-shaped mounting tabs located at a short distance from both corners of the upper edges of its side panels and four complementary mounting openings formed at its bottom panel such that when two or more trays are stacked together, the mounting openings of the tray on top will engage with the upstanding mounting tabs of the tray at the bottom to secure the trays together. Such unique location of the mounting construction provides strong resistance to impact force particularly lateral force imposing on a plurality of the strays stacked together.

It is still yet another object of the present invention to provide merchandise trays which can be fabricated readily without use of adhesive and yet have a rugged construction.

BRIEF DESCRIPTION OF THE DRAWINGS

Other objects of this invention will appear in the following description and appended claims reference being made to the accompanying drawings in which

FIGS. 29A, 29 B, and 29C are top and right front elevation views showing the mounting of a transverse divider in the tray for forming a right compartment and a left compartment in the interior of the tray.

DETAILED DESCRIPTION OF THE PREFERRED EMBODIMENTS

Figure 1:
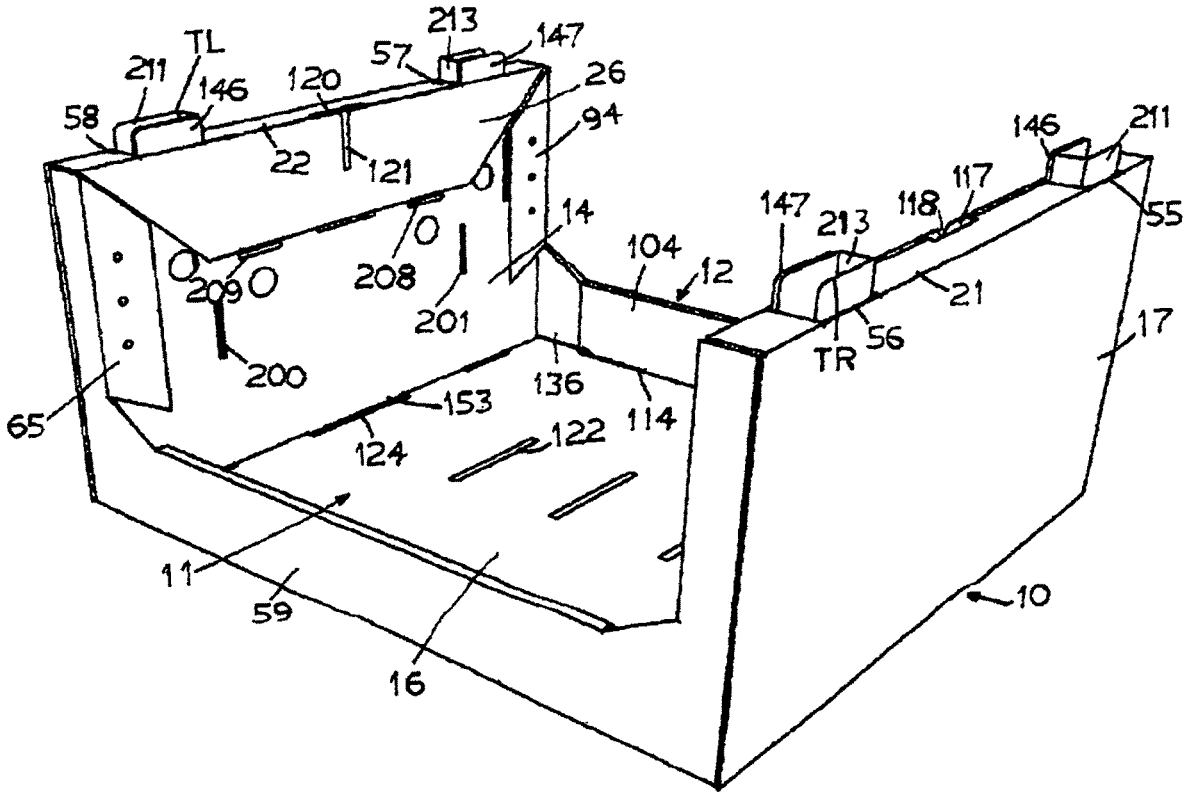
FIG. 1 is a front and top perspective right elevation view of the merchandise tray having open front and back according to the present invention such that merchandise placed in the tray is visible through the front and the back of the tray.
Figure 9:
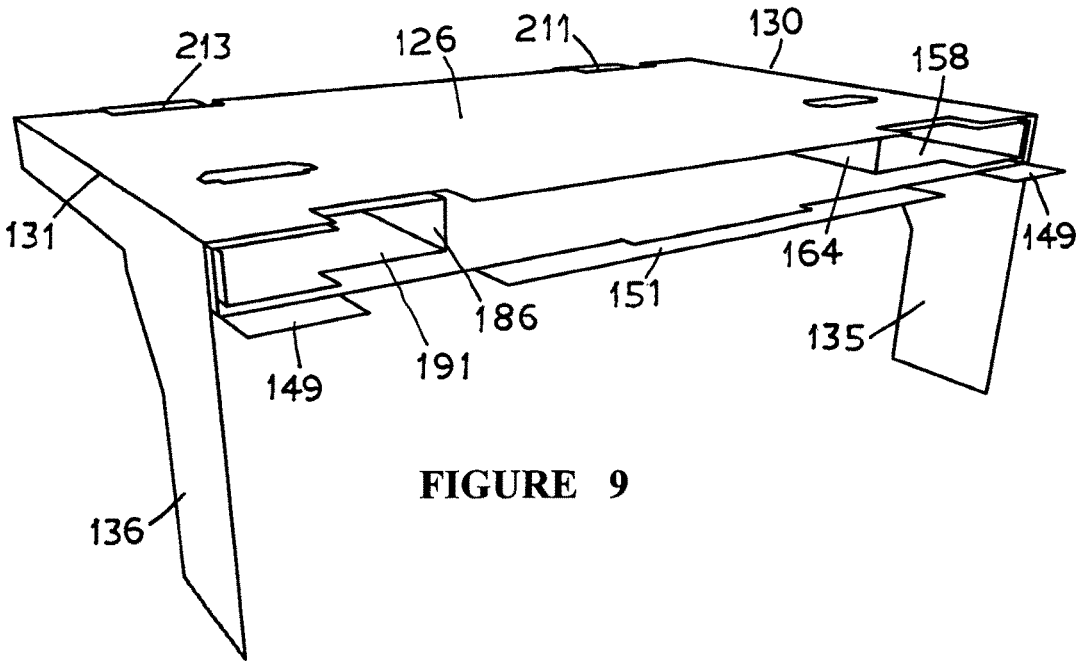
Figure 10:
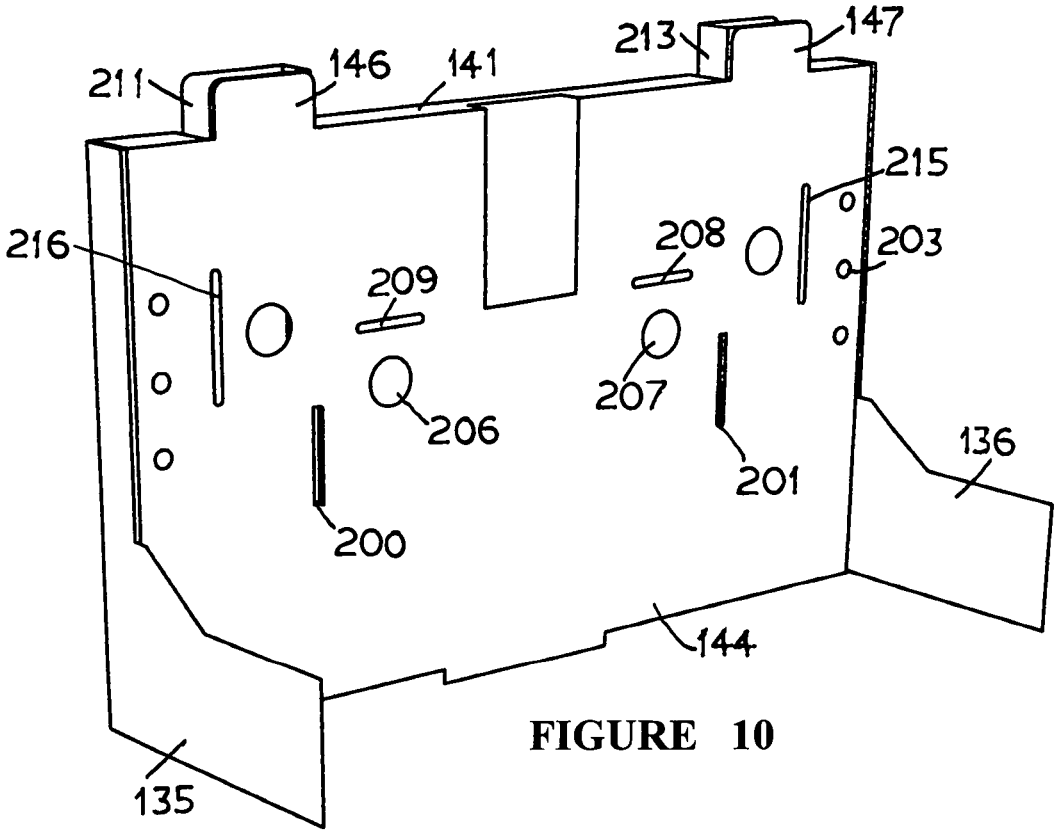
FIG. 10 is a front and left perspective elevation view of the insert unit.

With reference to the drawings wherein like reference numerals designate corresponding parts in the various views, the merchandise tray 10, as best shown in FIGS. 1, 9, and 10, of the present invention has an open front 11 and an open rear 12. The tray 10 comprises primarily of three components, namely a rectangular base unit 13 with two lateral side insert units 14 mounted at the two lateral sides of the base unit 11. The lateral side insert units 14 are identical to one other. All components may be made of corrugated cardboard. The base unit 11 may have various selected lengths to meet the tray user's requirement, while the same lateral side insert units 14 are commonly provided in trays of all sizes in a modular manner.

Figure 4:
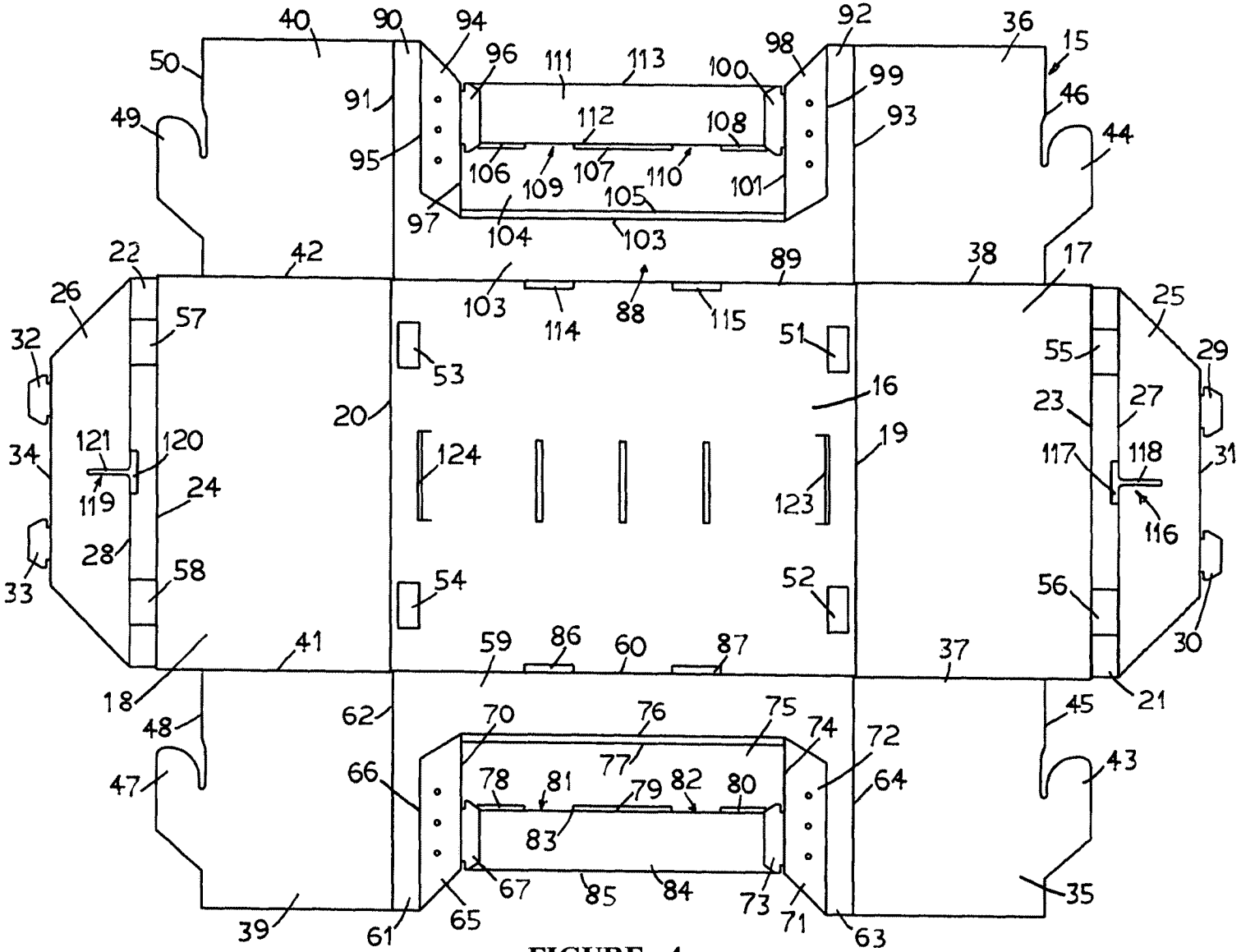
FIG. 4 is a top perspective elevation view of the blank having a geometric pattern for forming the base unit of the merchandise tray of the present invention.

The base unit 11 is fabricated with a cardboard blank 15, as best shown in FIG. 4, with a geometric pattern having a rectangular central panel 16. The cardboard blank 15 typically have overall dimensions of 60⅝ inches long and 43 inches wide. Two rectangular side panels 17 and 18 extends outward from the right side edge 19 and left side edge 20 respectively of the central panel 16. Two narrow rectangular holding panels 21 and 22 extend outwards from the outer edges 23 and 24 of the side panels 17 and 18 respectively. Two trapezoidal restraining panels 25 and 26 extends outward from the outer edges 27 and 28 of the holding panels 21 and 22 respectively. Two trapezoidal latching tabs 29 and 30 extend outward from the outer edge 31 of the restraining panel 25 and similarly two trapezoidal latching tabs 32 and 33 extend outward from the outer edge 34 of the restraining panel 26. Two generally rectangular latching panels 35 and 36 extend outward from the lower edge 37 and the upper edge 38 of the side panel 17, and similarly two generally rectangular latching panels 39 and 40 extend outward from the lower edge 41 and upper edge 42 of the side panel 18 respectively. The portion of the edges 37 and 38 of the latching panels 35 and 36 are cut lines such that the latching panels 35 and 36 may be separated from the side panel 17, similarly the portion of the edges 41 and 42 of the latching panels 39 and 40 are cut lines such that the latching panels 39 and 40 may be separated from the side panel 18. A hook-shaped tab 43 is provided at the outer edge 45 of the latching panel 35 and a similar hook-shaped tab 44 is provided at the outer edge 46 of the latching panel 36 respectively. Similarly, a hook-shaped tab 47 is formed at the outer edge 48 of the latching panel 39 and a similar hook-shaped tab 49 is formed at the outer edge 50 of the latching panel 40.

Two rectangular bottom openings 51 and 52 are formed adjacent the right side edge 19 of the central panel 16. These openings 51 and 52 are spaced a short distance from the upper and lower corners of the central panel 16 respectively. Two similar rectangular bottom openings 53 and 54 are formed adjacent to the left side edge 20 of the central panel 16, and these rectangular bottom openings 53 and 54 are spaced a similar short distance from the upper and lower corners of the central panel 16 respectively.

Two rectangular mounting openings 55 and 56 are formed in the narrow holding panel 21. These rectangular mounting openings 55 and 56 have the same dimensions as the bottom openings 51 and 52 formed in the central panel 16 and they are aligned at the same horizontal levels of the bottom openings 51 and 52 respectively. Similarly, two rectangular mounting openings 57 and 58 are formed in the narrow holding panel 22, these rectangular mounting openings 57 and 58 have the same dimensions as the bottom openings 53 and 54 formed in the central panel 16, and they are aligned at the same horizontal levels of the bottom openings 53 and 54 respectively.

An inverted generally U-shaped panel 59 extends outward from the bottom edge 60 of the central panel 16. The inverted U-shaped panel 59 has a left vertical side panel 61 having a common side edge 62 with the left latching panel 39, and a right vertical side panel 63 having a common side edge 64 with the right latching panel 35. A foldable left panel 65 extends outward from an inner edge 66 of the left vertical side panel 61, and a trapezoidal securement tab 67 is formed at the outer free edge 70 of the foldable left panel 65. Similarly, a foldable right panel 71 extends outward from an inner vertical edge 72 of the right vertical panel 63, and a trapezoidal securement tab 73 is formed at the inner free edge 74 of the foldable right panel 71. A horizontal rectangular center panel 75 extends downward from the middle portion of the U-shaped panel 59 from two parallel horizontal score lines 76 and 77 spaced narrowly and parallel from one another. Three rectangular openings 78, 79 and 80 are formed along the lower edge of the rectangular center panel 75 such that two spaced rectangular extension edge portions 81 and 82 are formed on the edge portion of the lower edge 83 of the center panel 75. A rectangular reinforcing panel 84 extend downward below the lower edge 83 of the center panel 75. Two spaced mounting tabs 81 and 82 will be formed by the rectangular extension edge portions 81 and 82 when the reinforcing panel 84 is folded against the enter panel 75 along the edge line 83. The vertical distance between the horizontal score line 77 and the score line 79, is equal to the distance between the bottom edge 60 of the central panel 16 and the upper score line 76 of the horizontal rectangular center panel 75. The reinforcing rectangular panel 84 has a bottom outer edge 85, and the distance between the score line 83 and the bottom outer edge 85 of the reinforcing rectangular panel 84 is equal to the distance between the horizontal score line 76 and the bottom edge 60 of the central panel 16. Two horizontal slot openings 86 and 87 are formed in the central panel 16 and located juxtaposed to the bottom edge 60. These slot openings 86 and 87 are spaced from one another in a distance equal to that of the space between the mounting tabs 81 and 82 located in the center rectangular panel 75 and the vertical position of these slot openings 86 and 87 are aligned with the mounting tabs 81 and 82 respectively.

Similarly, an inverted generally U-shaped panel 88 extends upward from the upper edge 89 of the central panel 16 and it has a left vertical panel 90 having common edge 91 with the latching panel 40, and right vertical panel 92 having a common edge 93 with the rectangular latching panel 36. A foldable left panel 94 extends outward from the inner vertical edge 95 of the left vertical panel 90. A trapezoidal mounting tab 96 is formed at the outer free edge 97 of the foldable left panel 94. A foldable right panel 98 extends outward from the inner vertical edge 99 of the right vertical panel 92, and a trapezoidal mounting tab 100 is formed at the outer free edge 101 of the foldable right panel 98. A horizontal score line 102 is formed at the upper edge of the middle section 103 of the U-shaped panel 88. A horizontal center panel 104 extends upward from the middle section 103 of the U-shaped panel 88. The horizontal center panel 104 has an upper horizontal score line 105 parallel to the score line 102 and spaced narrowly therefrom. The upper edge of the horizontal center panel 104 has three horizontal openings 106, 107 and 108. The right side of the left horizontal opening 106 is spaced from the left end of the middle horizontal opening 107 by a space 109, and the right end of the middle horizontal opening 107 is spaced from the left side of the horizontal opening 108 by a space 110. A horizontal reinforcing rectangular panel 111 extends outward above the center panel 104 which has a horizontal lower edge score line 112. Two spaced mounting tabs 109 and 110 will be formed at the upper edge portion when the reinforcing panel 111 is folded against the center panel 104 along the edge score line 112. The reinforcing horizontal panel 111 has an outer free edge 113. Two spaced slot openings 114 and 115 are formed in upper edge portion 89 of the central panel 16. These slot openings 114 and 115 are spaced from one another equal to the distance between the mounting tabs 109 and 110 and aligned with the vertical positions of the latter.

A T-shaped opening 116 is formed between the holding panel 21 and the restraining panel 25 with a vertical slot section 117 located at the center juxtaposed to the edge 27 of the holding panel 21, and a horizontal slot opening 118 perpendicular to the slot opening 117 and extending into the restraining panel 25. Similarly, a T-shaped opening 119 is formed between the holding panel 22 and the restraining panel 26 with a vertical slot section 120 located at the center juxtaposed to the edge 28 of the holding panel 22, and a horizontal slot opening 121 perpendicular to the slot opening 120 and extending into the restraining panel 26.

A plurality of transverse slot openings 122 mutually parallel and spaced from one another are formed in the center of the central panel 16.

Two transverse mounting slots 123 and 124 parallel to the side edges 19 and 20 of the central panel 16 respectively and spaced from these side edges at a distance equal to the thickness of the insert unit 14.

Figure 5:
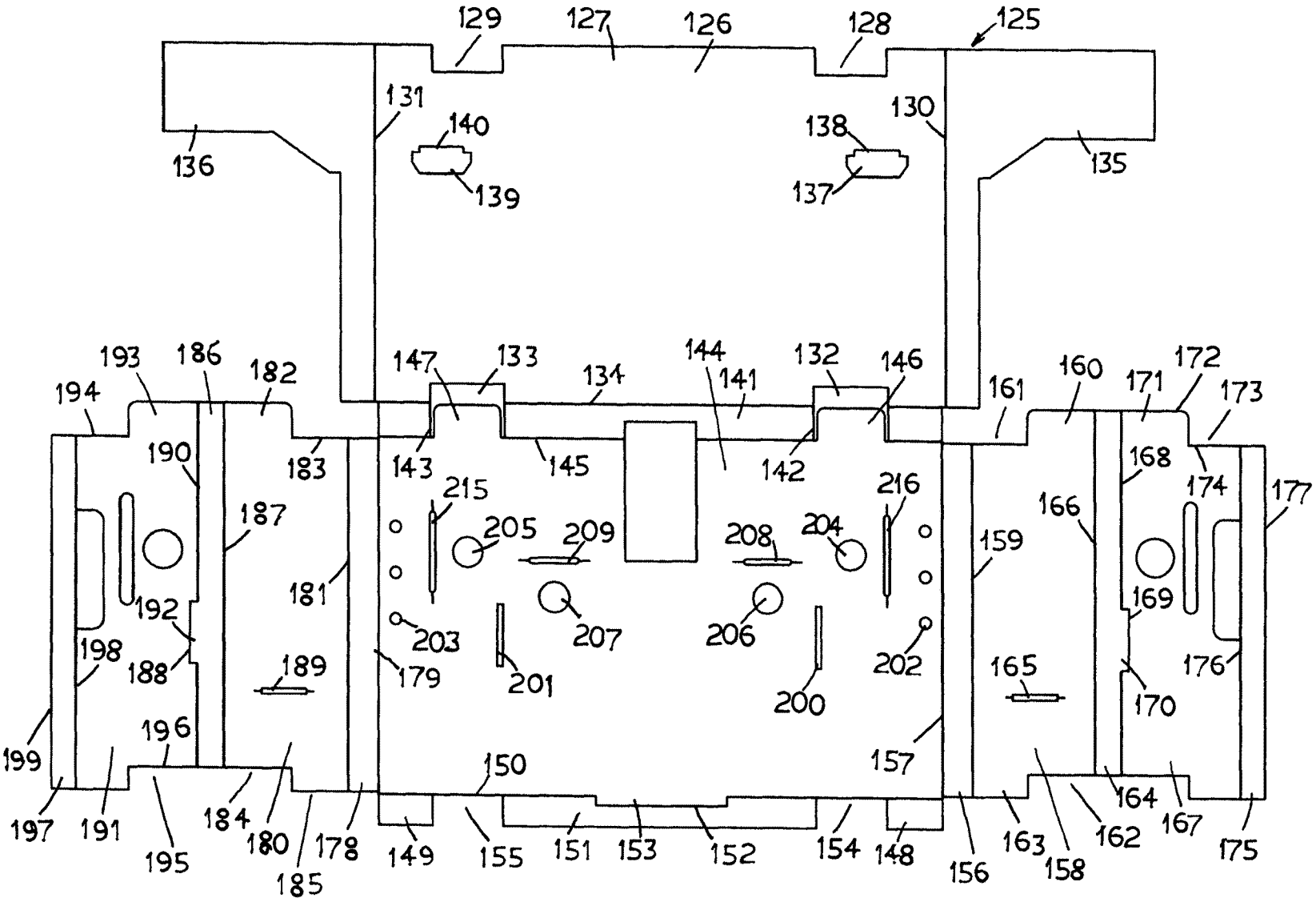
FIG. 5 is a top perspective elevation view of the blank having a geometric pattern for forming the insert unit of the merchandise tray of the present invention.

The insert unit 14 is fabricated with a cardboard blank as best shown in FIG. 5, with a geometric pattern 125 imprinted and stamped thereon. The blank has typical dimensions of 41.124 inches by 51.5 inches such that it can be produced in a corrugator in a direction that the flutes of the corrugated board subsequently forming the various panels of the insert unit are orientated in the vertical direction of the panels so as to provide maximum strength for the panels to support impact force imposed on the panels in use of the tray. The geometric pattern has a generally rectangular outer main panel 126 having an upper edge 127. Two rectangular cut outs 128 and 129 having the same width are formed at the upper edge 127. These cut outs 128 and 129 are spaced from the right edge 130 and left edge 131 of the main panel 126 respectively. Two similar rectangular cut outs 132 and 133 are also formed at the lower edge 134 of the main panel 126. The vertical position of the cut out 128 is aligned with the vertical cut out 132 and the vertical position of the cut out 129 is aligned with the vertical cut out 133. A right inverted L-shaped panel 135 extends outward from the vertical right edge 130 of the main panel 126, and a left inverted L-shaped panel 136 extends outward from the vertical left edge 131 of the main panel 126. A right trapezoidal shape latch member 137 is formed at the right upper corner portion of the main panel 126 and spaced from the left edge 130. The right trapezoidal shape latch member 137 has an upper pivot line 138 whereby the right trapezoidal shape latch member 137 may be pushed out from the main panel 126 in a pivotal manner with respect to the pivot line 138. A left trapezoidal shape latch member 139 is formed at the left upper corner portion of the main panel 126 and spaced from the vertical left edge 131. The left trapezoidal shape latch member 139 has an upper pivot line 140 such that it may be pushed out in a pivotal manner from the main panel 126 with respect to the pivot line 140. A space panel 141 extends downward from the bottom edge 134 of the main panel 126. Two rectangular cut outs 142 and 143 are formed in the space panel 141. The rectangular cut outs 142 and 143 are aligned with the cut outs 132 and 133 respectively formed in the lower edge portion of the main panel 126. A generally rectangular inner panel 144 having dimensions equal to those of the outer main panel 126, extends downward from the lower edge 145 of the of the space panel 141. The lower edge 145 also serves as the upper edge of the inner panel 144. Two rectangular tabs 146 and 147 are formed at the upper edge of the inner panel 144. These rectangular tabs 146 and 147 extend into the rectangular cut outs 142 and 143 respectively of the space panel 141. Two rectangular extension panels 148 and 149 extend from the right and left sides of the lower edge 150 of the inner panel 144, and a rectangular middle extension panel 151 extends outward from the center portion of the lower edge 150. A generally U-shaped scored line 152 is formed in the middle portion of the upper edge 150 such that when the extension panel 151 is folded with respect to the fold line 150 as well as the scored line 152, a rectangular tab 153 extending outward from the lower edge 150 is formed at the center portion of the lower edge 150. A rectangular right space 154 is provided between the right extension panel 148 and the left side of the middle extension panel 151, and a similar rectangular space 155 is provided between the left side of the right extension panel 149 and the left side of the middle extension panel 151. The positions of the rectangular spaces 154 and 155 are aligned with the positions of the rectangular cut outs 128 and 129 in the vertical direction and have mutually equal dimensions.

A vertical right side panel 156 extends outward from the right side edge 157 of the inner panel 144. The width of the right side panel 156 is equal to the width between the lower edge 134 and the upper edge 145 of the inner panel 144. A generally rectangular vertical right middle panel 158 extends outward from the right side edge 159 of the right side panel 156. A rectangular extension portion 160 extends outward upwardly from the upper right edge portion of the upper edge 161 of the right middle panel 158 and abutting the vertical line 166. The dimensions of the rectangular extension portion 160 are equal to those of the rectangular tab 146 formed at the upper edge 145 of the inner panel 144. A rectangular cut out 162 is provided at the right lower edge portion of the lower edge 163 of the right middle panel 158. The width of the rectangular cut out 162 is equal to the width of the rectangular tab 160. A horizontal mounting slot opening 165 is formed at the lower portion of the middle panel 158. The width of the mounting slot opening 165 is equal to the horizontal width of the trapezoidal shape latch member 137 formed in the main panel 126. A generally rectangular vertical right space panel 164 extends outward from the vertical right edge 166. The vertical right space panel 164 has a width equal to that of the right side panel 156. A generally rectangular abutment panel 167 extends sideway outwardly from the vertical right side edge 168 of the vertical right space panel 164. A generally reverse C-shaped score line 169 is formed at the vertical right edge 168 such that when the abutment panel 167 is folded with respect to the edge 168 a vertical securement tab 170 is formed at the portion of the vertical right edge 168 at which the C-shaped score line is formed. A rectangular extension portion 171 extends upwardly from the left upper portion of the upper edge 172 and abutting the vertical line 168. The dimensions of the extension portion 171 of the abutment panel 167 are equal to those of the extension portion 160 of the right middle panel 158. A rectangular cut out 173 is formed at the right upper edge portion 174 of the upper edge 172 of the abutment panel 167. The width and height of the abutment panel 167 are equal to the width and height of the right meddle panel 158. A vertical rectangular end panel 175 extends outward from the vertical right edge 176 of the abutment panel 167. The end panel 175 has a vertical right free edge 177.

Similarly, the components on the left side of the inner panel 144 are mirror images of the components on the right side of the inner panel 144 and having dimensions equal to one another. They comprise of a rectangular vertical left side panel 178 extends outward from the vertical side edge 179 of the inner panel 144. A generally rectangular left middle panel 180 extends from the vertical side edge 181 of the left side panel 178 and having a rectangular extension edge portion 182 extending upward from the upper left portion of its upper edge 183. A rectangular cut out 184 is formed at the left edge portion of its lower edge 185. A vertical rectangular left space panel 186 extend leftward from its left vertical side edge 187. A horizontal mounting slot opening 189 is formed in the lower portion of the middle panel 180. The horizontal width of the mounting slot opening 189 is equal to the horizontal width of the trapezoidal latch member 139 formed in the main panel 126. The left side of the rectangular extension edge portion 182 abuts the upper end portion of the right side edge 187. A C-shaped score line 188 is formed at a middle portion of the left vertical side edge 190 of the left side space panel 186. A generally rectangular left abutment panel 191 extends outward to the left side of the vertical left side edge 190. A securement tab 192 will be formed at the C-shaped score line when the left abutment panel 191 is folded with respect to the edge 190. A rectangular extension portion 192 is formed at the upper right edge portion of the upper edge 194. A rectangular cut out 195 is formed at the lower right portion of the lower edge 196 of the left abutment panel 191. A vertical rectangular left end panel 197 extends out the left side edge 198 of the left abutment panel 191. The left end panel 197 has an outer vertical free edge 199.

Two vertical mounting slots 200 and 201 are formed in the inner panel 144. The horizontal position of the mounting slots 200 and 201 are aligned to the same horizontal level of the positions of the securement tabs 170 and 192. The distance between the mounting slot 200 and the right side edge 157 of the inner panel 144 is equal to the width of the right middle panel 158 as well as right abutment panel 167, and the width of the distance between the mounting slot 201 and the left side edge 179 of the inner panel 144 is equal to the width of the left middle panel 180 as well as the left abutment panel 191.

A plurality of accessories mounting openings 202 are formed in the middle edge portion of the inner panel 144 and located adjacent to the right side edge 157 therein, and similar accessories mounting openings 203 are formed in the middle of the left edge portion of the inner panel 144 and located adjacent to the left side edge 179 therein. Additional accessories mounting openings 204, 205, 206 and 207 are formed in the middle portion of the inner panel 144. These openings may be used for providing longitudinal mounting rods extending between the two lateral sides of the tray.

Two horizontal mounting slot openings 208 and 209 are formed in the inner panel 144 and located adjacent to the top edge 145 therein.

Figure 6:
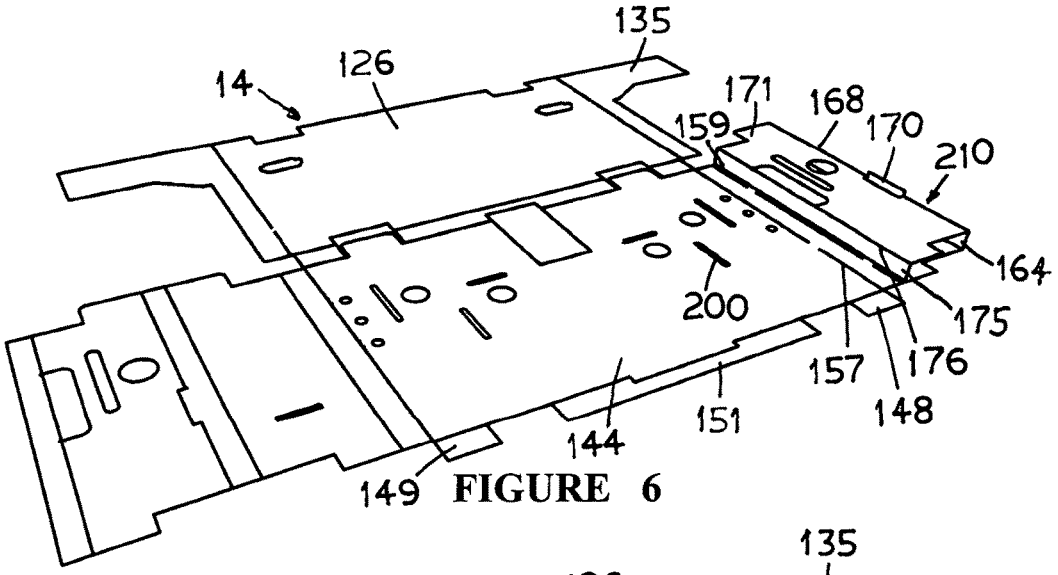
FIGS. 6 to 9 are front and top perspective elevation views showing the formation of the insert unit by folding various panels with respect to their edges serving as fold lines.
Figure 7:
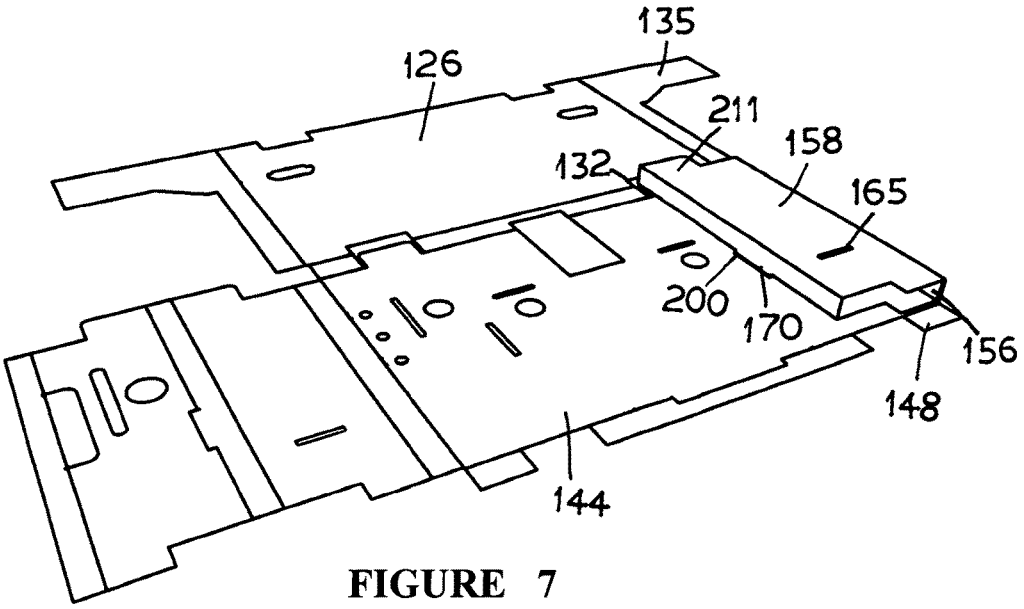
Figure 8:
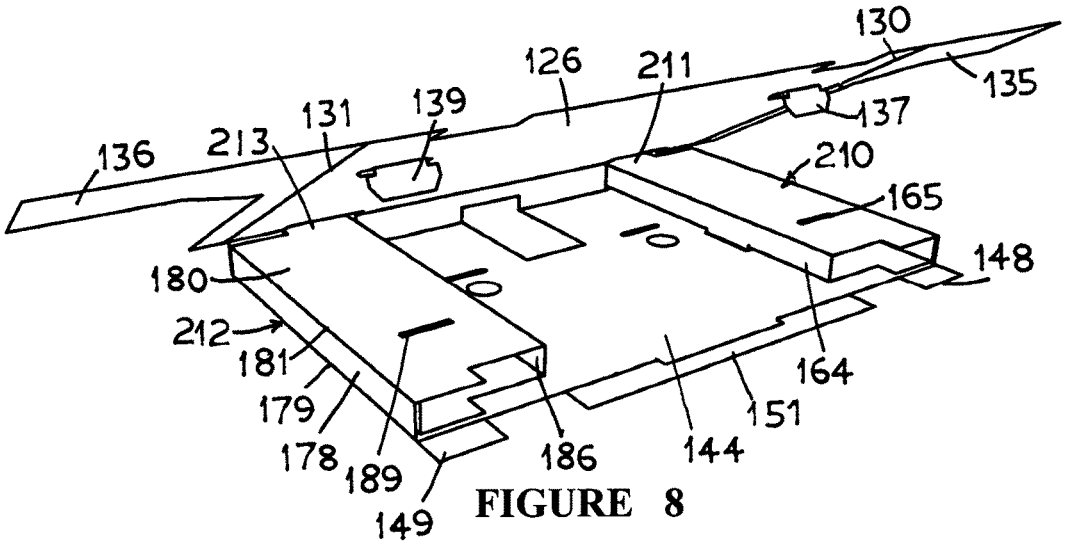
Figure 11:
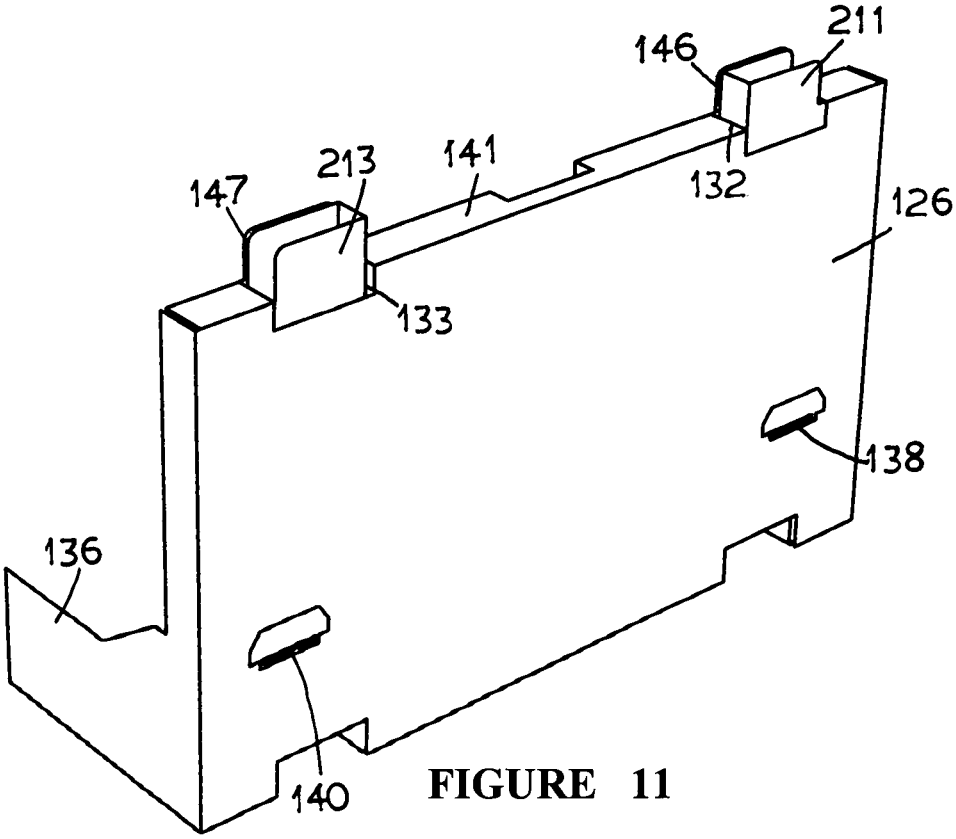
FIG. 11 is a top and right rear perspective elevation view of the insert unit.
Figure 12:
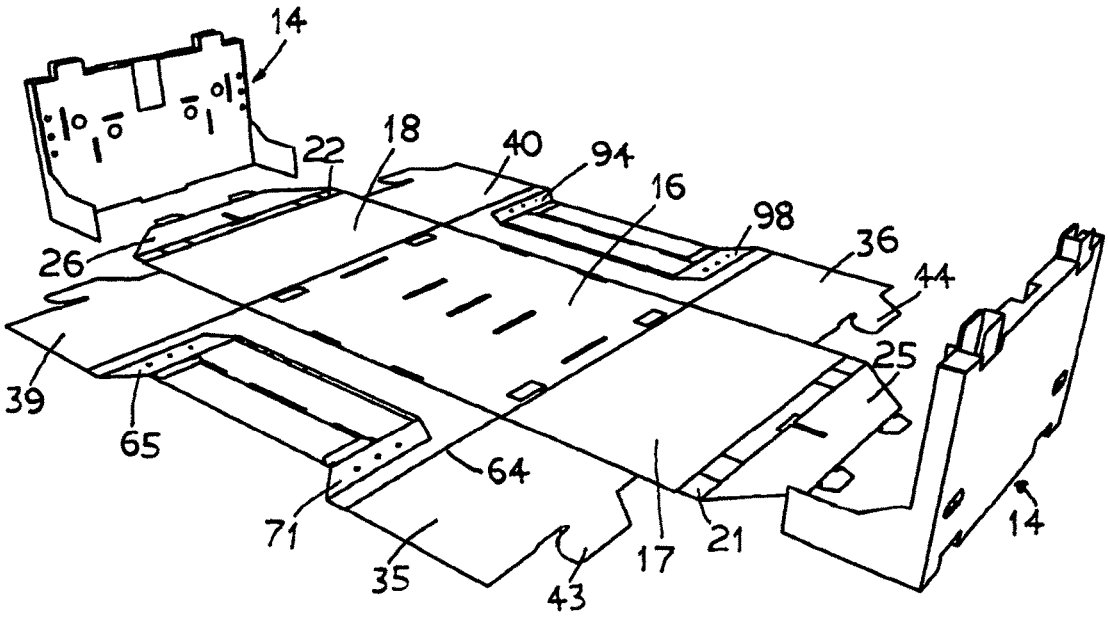
FIGS. 12 to 14 are top and right front perspective elevation views showing the formation of the base unit of the tray, according to the present invention, by folding along various panel edges as fold lines.
Figure 13:
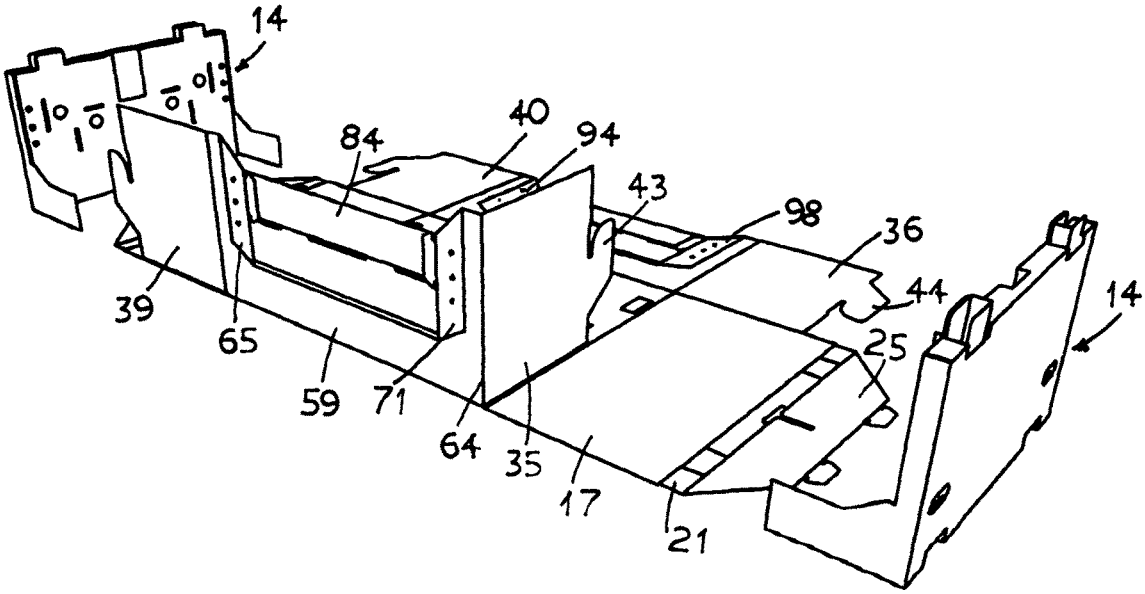

As shown in FIGS. 6 to 9, the insert unit 14 is formed by folding its various panels along the panel edges as fold lines. As shown in FIG. 6, a right rectangular box-like case 210 is formed by folding the right panels 167, 158 and 175 along their vertical edges 159, 166, 168 and 176 such that the right abutment panel 167 lies in a spaced manner on top of the right middle panel 158 and they are maintained mutually parallel and spaced from one another by the right spaced panel 164 and the right end panel 175. The rectangular extension portions 160 and 171 at the top edges 161 and 174 of the right middle panel 158 and right abutment panel 167 respectively co-operate with one another to form a vertical upright U-shaped mounting tab 211 at the top end of the case 210. The case 210 is then folded along the edges 157 and 159 of the right side panel 156 until the case 210 lies on top of the right side edge portion of the inner panel 144 as best shown in FIG. 7. The securement tab 170 will engage with the vertical slot opening 200 to secure the case 210 fixedly mounted in place. Similarly, as est shown in FIG. 8, a left rectangular box-like case 212 same as the right rectangular case 210 is formed on the left side of the inner panel 144 by folding the left panels 180, 186, 197 along their vertical side edges 187, 190, 198 and 199. The rectangular extension portions 182 and 193 of the left middle panel 180 and the left abutment panel 191 co-operate with one another to form a another vertical upright U-shaped mounting tab 213 at the upper edge portion of the left case 212. The left case 212 is then folded along the vertical lines 179 and 181 of the left side panel 179 until the case 213 lies juxtapose on top of the left edge portion of the inner panel 144. The U-shaped mounting tab 211 has an open side facing the right side edge of the top of the case 210, and the U-shaped mounting tab 213 has an open side facing the left side edge of the top of the case 212. Finally, as best shown in FIG. 9, the outer main panel 126 is folded downward to lie on top of the cases 210 and 212. The trapezoidal latching members 137 and 139 are pushed out to engage with the horizontal mounting slots 165 and 189 respectively to maintain the outer main panel 126 securely mounted in place. The inverted L-shaped panels 135 and 136 are folded along the edges 130 and 131 respectively until they lie perpendicular to the main panel 126. The U-shaped mounting tabs 211 ans 213 extend vertically upward from the top of the insert unit 14 through openings formed by the cut outs 132 and 133 as best shown in FIG. 1. The left U-shaped mounting tab has a U-shaped top edge TL, and the right U-shaped mounting tab has a similar U-shaped top edeg TR. The rectangular extension tabs 147 and 146 formed at the upper edge 145 extend contiguous to the U-shaped mounting tabs 211 and 213 respectively as best shown in FIGS. 10 and 11 to provide reinforcement to the U-shaped mounting tabs 211 and 213.

Figure 2:
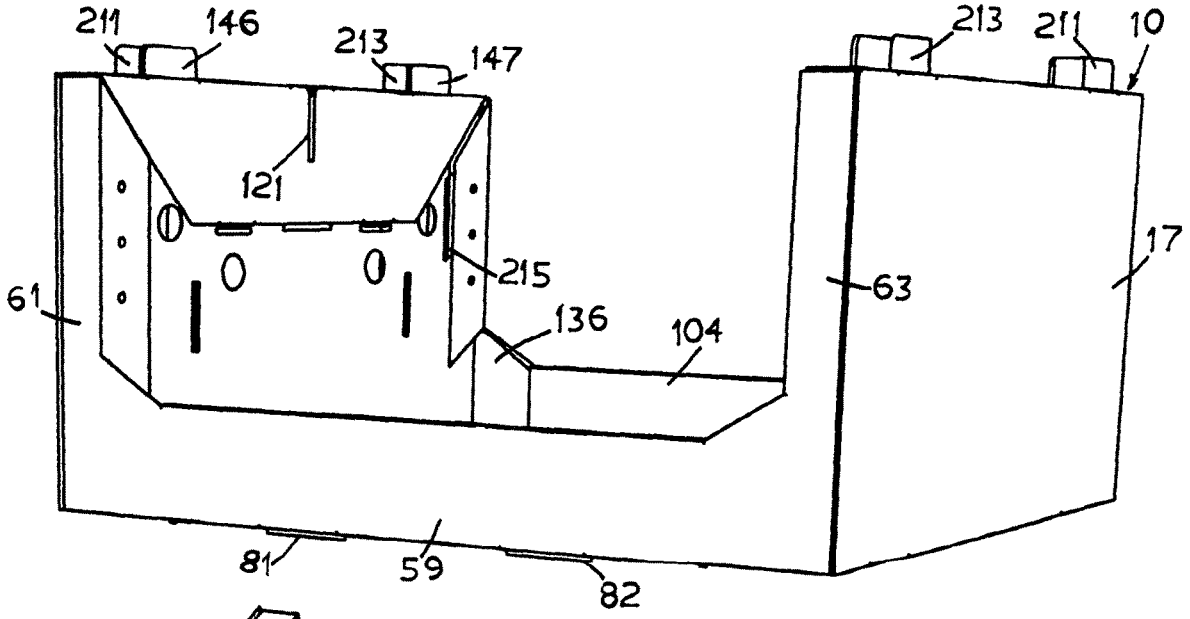
FIG. 2 is a front and right perspective elevation view of the merchandise tray.
Figure 3:
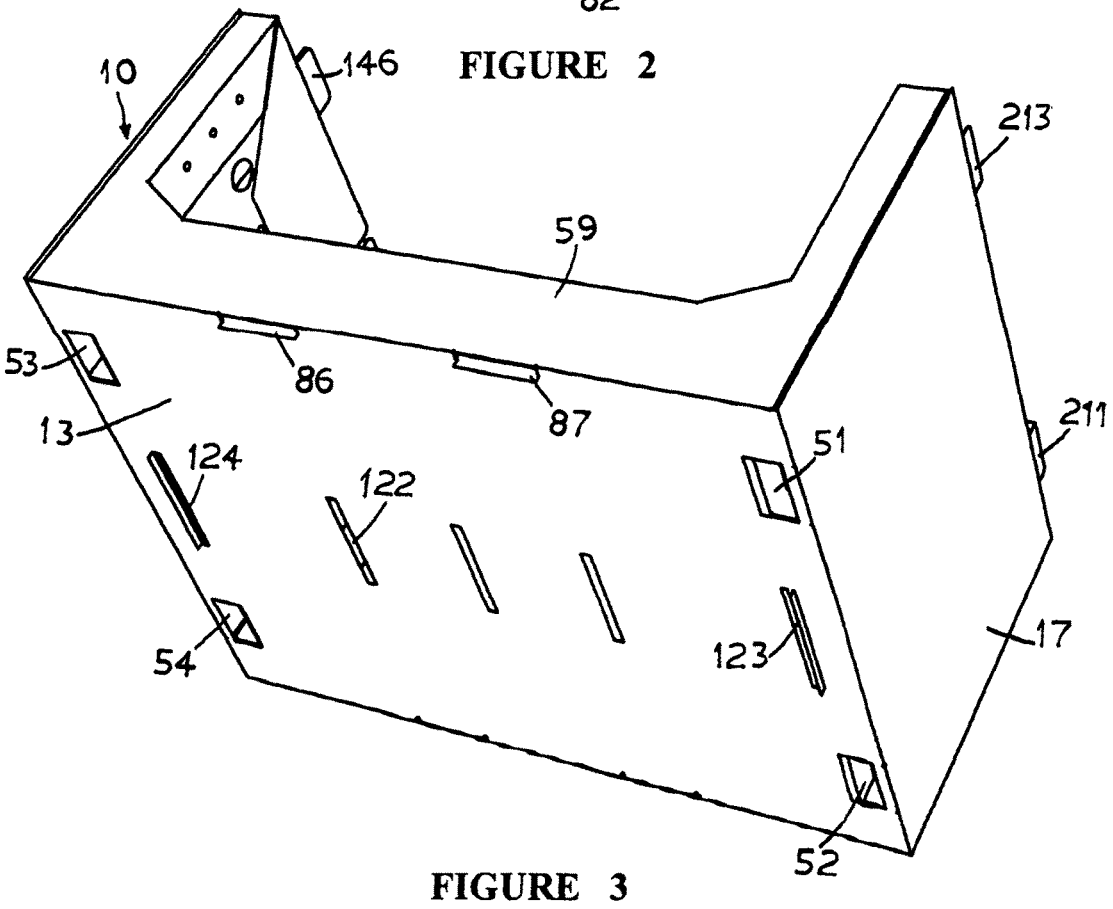
FIG. 3 is a bottom and right perspective elevation view of the merchandise tray.
Figure 14:
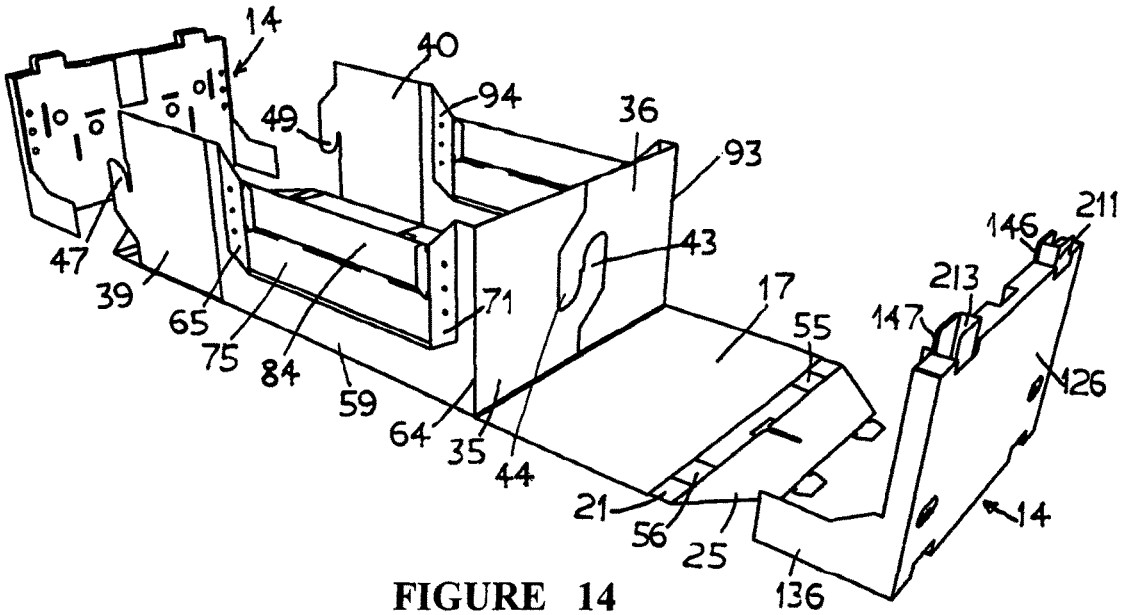
Figure 15:
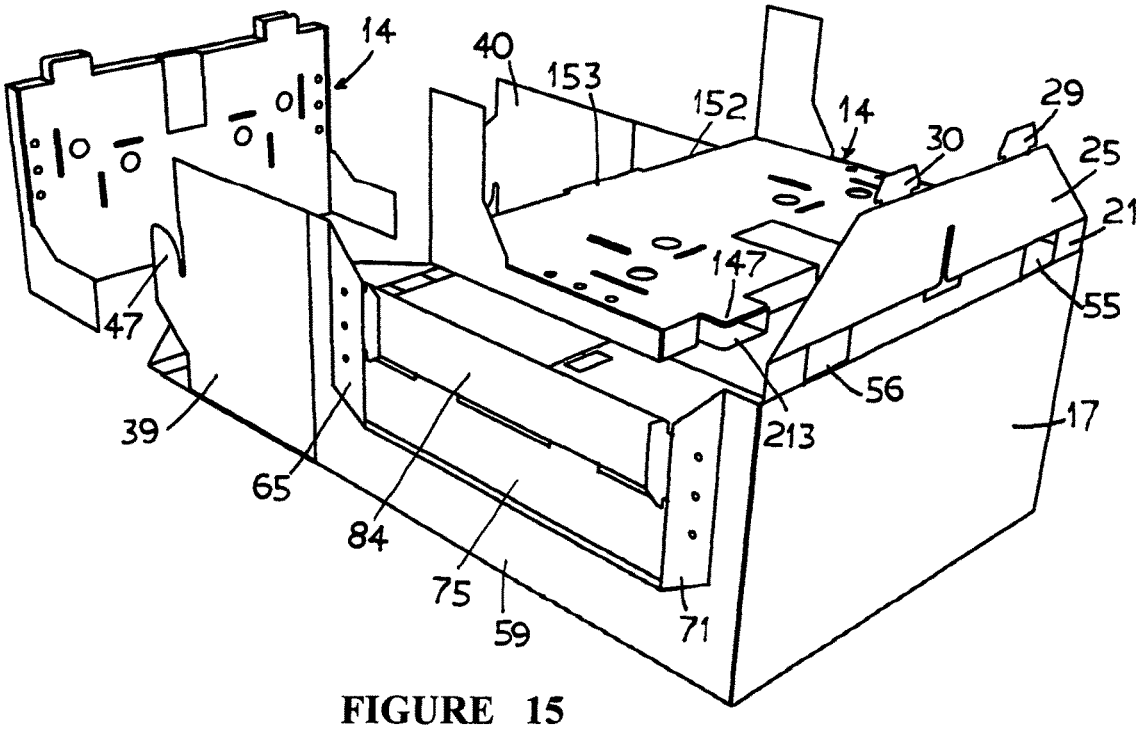
FIG. 15 is a top and right front perspective elevation view showing the mounting of the inert unit in the base unit to form the tray of the present invention.

The tray 10 of the present invention is assembled as best shown in FIGS. 12 to 15. The blank of the base unit 11 is placed on a flat surface such as the ground, and the U-shape front panel 59 and the U-shape rear panel 103 are folded upward with respect to the edges 60 and 89 respectively then the latching panels 35 and 36 at the right hand side are folded with respect to their edges 37 and 38 respectively until they lie perpendicular to the U-shape front panel 59 and U-shape rear panel 103 with the hook-shape tabs 43 and 44 latching with one another to maintain the latching panels 35 and 36 fixedly mounted in place as shown in FIG. 14. The side panel 17 is then folded upward until it lies contiguous with the latching panels 35 and 36, as best shown in FIG. 15, to form a double layer side panel at the left side of the tray 10. An insert unit 14 is positioned in the horizontal manner as shown in FIG. 15 with its U-shape mounting tabs 211 and 213 together with the rectangular panels 146 and 147 aligned with the mounting tabs 211 and 213 and inserted into the mounting openings 55 and 56 respectively of the holding panel 21. The insert unit 14 is then pivoted downward until it is located in an upright manner within the right side of the base unit 11 with its main panel 126 contacting the inner surface of the latching panels 35 and 36. The bottom edge of the L-shaped panels 135 and 136 of the insert unit will abut the central panel 16 to further maintain the insert unit 11 in an upright position. The rectangular tab 151 will engage with the mounting slot 123 in the central panel 16 to maintain the insert unit 14 fixedly mounted in an upright position within the base unit 11. Similarly, an insert unit 14 is mounted fixedly at the left side of the base unit 11 as best shown in FIGS. 1 and 2 with the rectangular tab 153 engaged with the mounting slot 124 in the central panel 16. The lower leg portion of the L-shape panels 135 and 136 of the insert unit 14 also lie contiguous to the inside surface of the front panel 59 and the rear panel 103 and their lower edges will contact against the central panel 16 to further maintain the insert unit 14 in the upright mounted position. In the above manner, the box-like cases 210 and 212 of the insert unit form two vertical hollow columns within each lateral side of the tray to provide a very rugged structure for supporting and resisting vertical force exerted to the lateral sides of the tray.

The U-shaped panel 59 together with the rectangular center panel 75 and outer reinforcing rectangular panel 84 are pivoted upward along the lower edge 60 of the central panel 16 until the U-shaped panel 59 lies perpendicular to the central 16. The rectangular center panel 75 and the reinforcing rectangular panel 84 are then double-folded with respect to the score lines 76, 77 and 83 such that the reinforcing rectangular panel 84 is sandwiched between the cross portion of the U-shaped panel and the rectangular center panel 75 to form a strong composite triple layer casing at the cross portion of the U-shaped panel 59 at the front of the tray 10 as well as covering on top of the lower leg portion of the L-shape panel 135 of the insert unit as shown in FIG. 1. The mounting tabs 81 and 82 located at the edge 83 of the rectangular reinforce panel 84 which abuts the central panel 16, will engage with the slot openings 86 and 87 in the central panel 16 to maintain the triple layer casing mounted fixedly in place as well as pressing and holding the lower leg portion of the L-shape panel of the insert unit against the inner surface of the front panel 59 to further secure the insert unit 14 in the upright mounted position within the base unit 11.

In a similar manner, a composite triple layer casing is formed at the cross portion of the U-shaped rear wall of the tray by folding the upper rectangular center panel 104 and upper reinforcing panel 111 along the score lines 102, 105, and 112, and an insert unit 14 is mounted fixedly in an upright position within the left side of the base unit 11 as best shown in FIGS. 1 and 2.

As an exemplary illustration shown in FIGS. 1 and 2, the insert unit 14 in the left side of the tray is additionally mounted securely to the base unit 11 by folding the foldable panels 65 and 94 of the front and rear L-shape panels over the vertical side edge portions of the insert unit with the trapezoidal shape securement tabs 67 and 96 of the foldable panels 65 and 94 engaging with the vertical mounting slots 216 and 215 at the inner panel 144 respectively of the insert unit 14. Similarly, the insert unit in the right side of the tray is additionally mounted securely to the base unit 11 by folding the foldable panels 71 and 98 of the L-shape front and rear panels over the insert unit in the right side of the tray. The insert unit 14 is furthermore secured in the mounted position with the base unit 11 by folding the trapezoidal restraining panel 26 over the top and the top edge portion of the inner panel 126 of the insert unit 14 as shown in FIGS. 1 and 2 with the trapezoidal latch tabs 32 and 33 engaging with the horizontal mounting slot openings 208 and 209 of the inner panel 144 of the insert unit 14, similarly, the trapezoidal restraining panel 25 is folded over the top and top edge portion of the inner panel 126 of the insert unit at the right side of the base unit 11.

The U-shape mounting tabs 211 and 213 of the insert unit 14 at the left side of the tray extend upward through the openings 58 and 57 respectively of the holding panels 22 at the left side of the tray and similarly the U-shape mounting tabs 211 and 213 of the insert unit at the right side of the tray extend upward through the openings 55 and 56 respectively of the holding panel 21. The U-shape mounting tabs 211 and 213 are thus located spaced from the two ends of the holding panels 21 and 22 which are the top edges of the tray. The rectangular panels 146 and 147 of the trapezoidal panel 26 lie contiguous to the inner side of the U-shape mounting tabs 211 and 213, and the rectangular panels 146 and 147 of the trapezoidal panel 25 also lie contiguous to the inner side of the U-shape mounting tabs 211 and 213 respectively at the right side of the tray to provide additional strength to the upstanding tabs for withstanding lateral impact force exerted to two or a plurality of trays stacked together.

Figure 16:
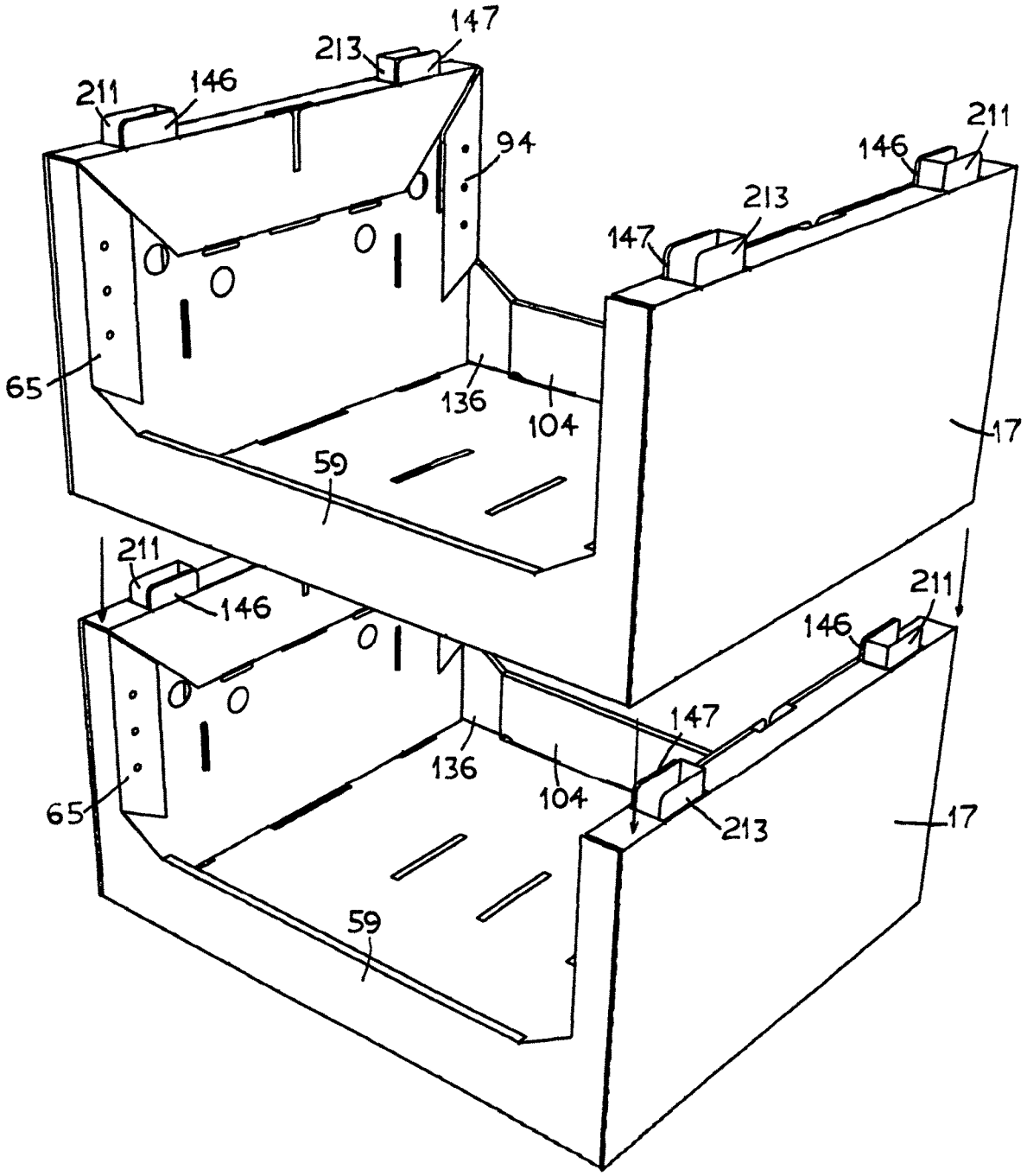
FIG. 16 is a top and right front perspective elevation view showing the positioning of two trays of the present invention for stacking one on top of the other.

As shown in FIG. 16, two trays 10 of the present invention may be positioned one over the top of the other and inserting the upstanding tabs 211 and 213 together with the reinforcing rectangular panels 147 and 146 on the right side of the tray at the bottom as well as the upstanding mounting tabs 211 and 213 together with the reinforcing rectangular panels, inserted into the mounting openings 51 and 52 located at the bottom of the tray on top for holding the two trays securely mounted together. The combination of the U-shape mounting tabs together with the reinforcing rectangular panels provides strong resistance to accidental external impact lateral force exerted to the mounting tabs. The spacing of the mounting tabs 211 and 213 from the corner edges of the side panels of the tray will dissipate the accidental lateral impact force to the entire side panel including the insert unit and the side panels 17 and 18 of the tray of the present invention whereas in prior art merchandise trays wherein the mounting tabs are located at the corners of the tray, the accidental lateral impact force is concentrated at the vertical side edges of the tray to cause distortion of its side panels. The hollow columns provided by the box-like cases 210 and 212 in the insert units provide a very strong structure to support vertical weight and force exerted to the lateral sides of the tray.

Figure 17:
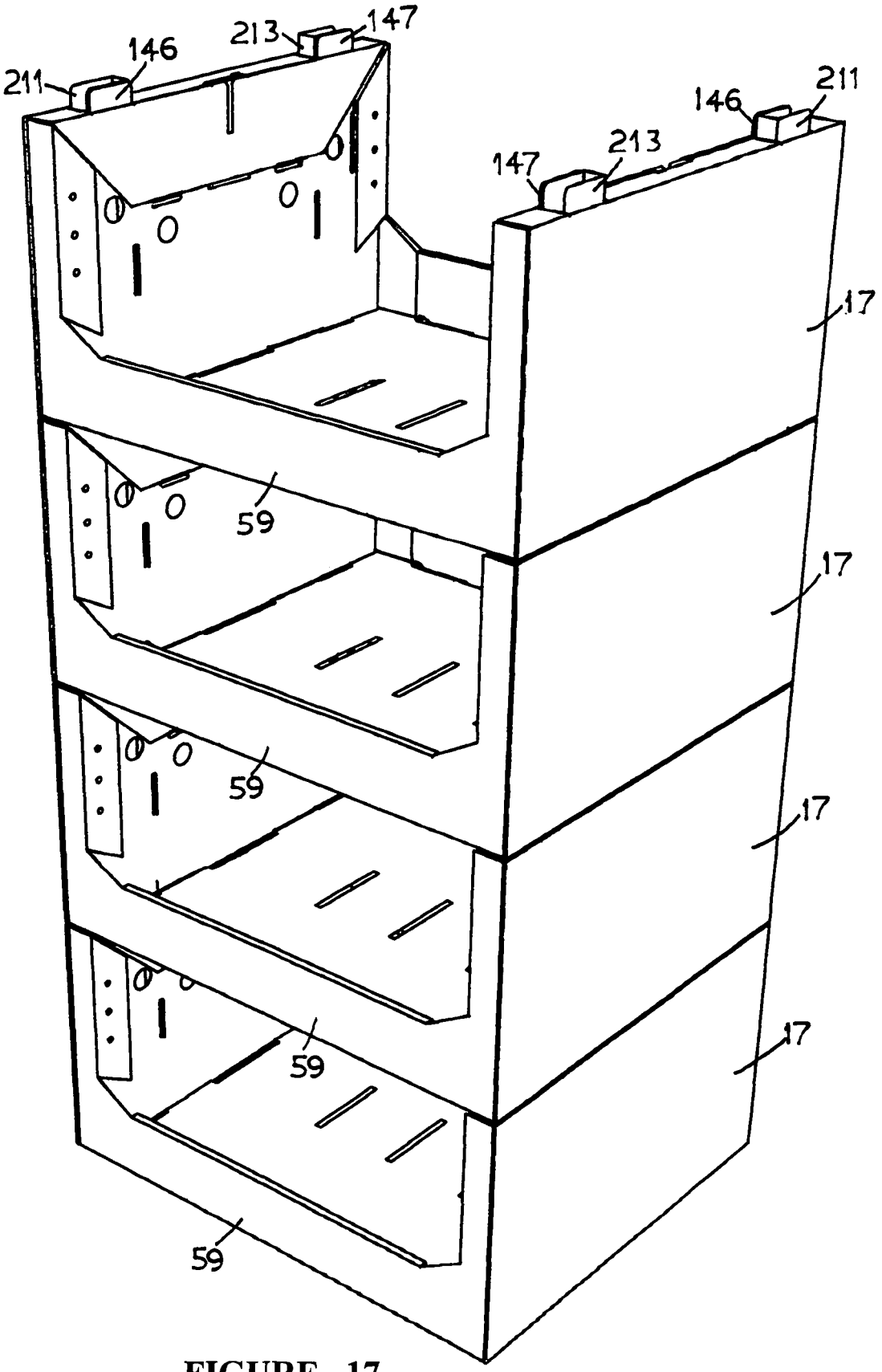
FIG. 17 is a top and right front perspective elevation view showing the stacking together of a plurality of the trays according to the present invention.

As shown in FIG. 17, a plurality of trays of the present invention may be stacked together in the same manner. The insert units provide strong support of vertical force both due to the weight of the merchandise placed in the tray as well as external vertical force exerted on the stack. The vertical orientation of the flutes in the cardboard forming the side wall panels of the base unit and the insert units, as described above, provide additional strength for supporting and resisting vertical forces imposed on the tray and the stack of the plurality of trays of the present invention.

Same insert units may be used for readily fabricating trays of various selected sizes according to the present invention in a modular fashion with base units of various selected widths.

Figure 18:
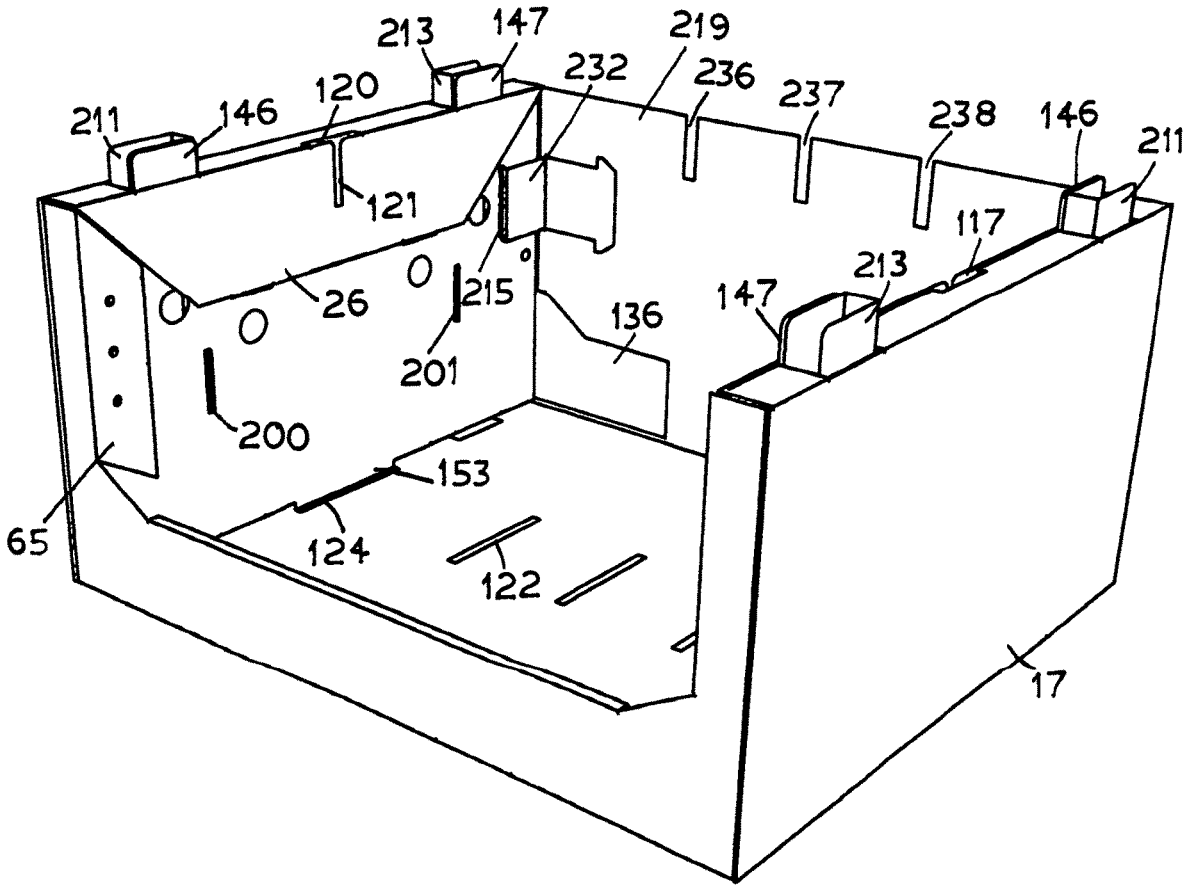
FIG. 18 is a top and right front perspective elevation view of a second embodiment of the present invention having an open front and an enclosed rear.
Figure 19:
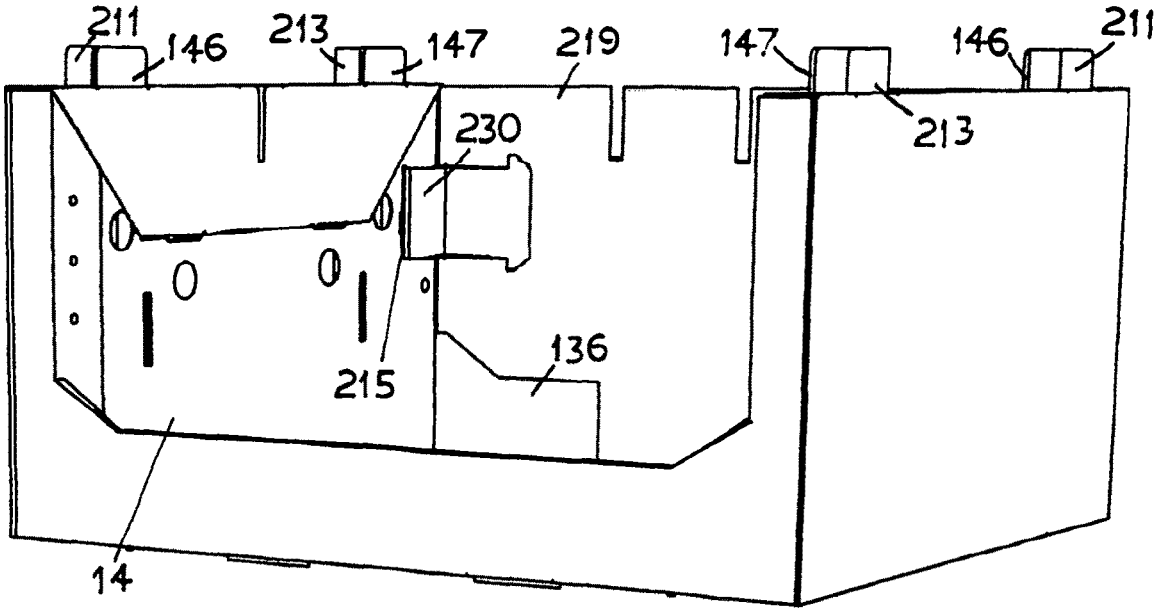
FIG. 19 is a right front perspective elevation view of the second embodiment shown in FIG. 18.
Figure 20:
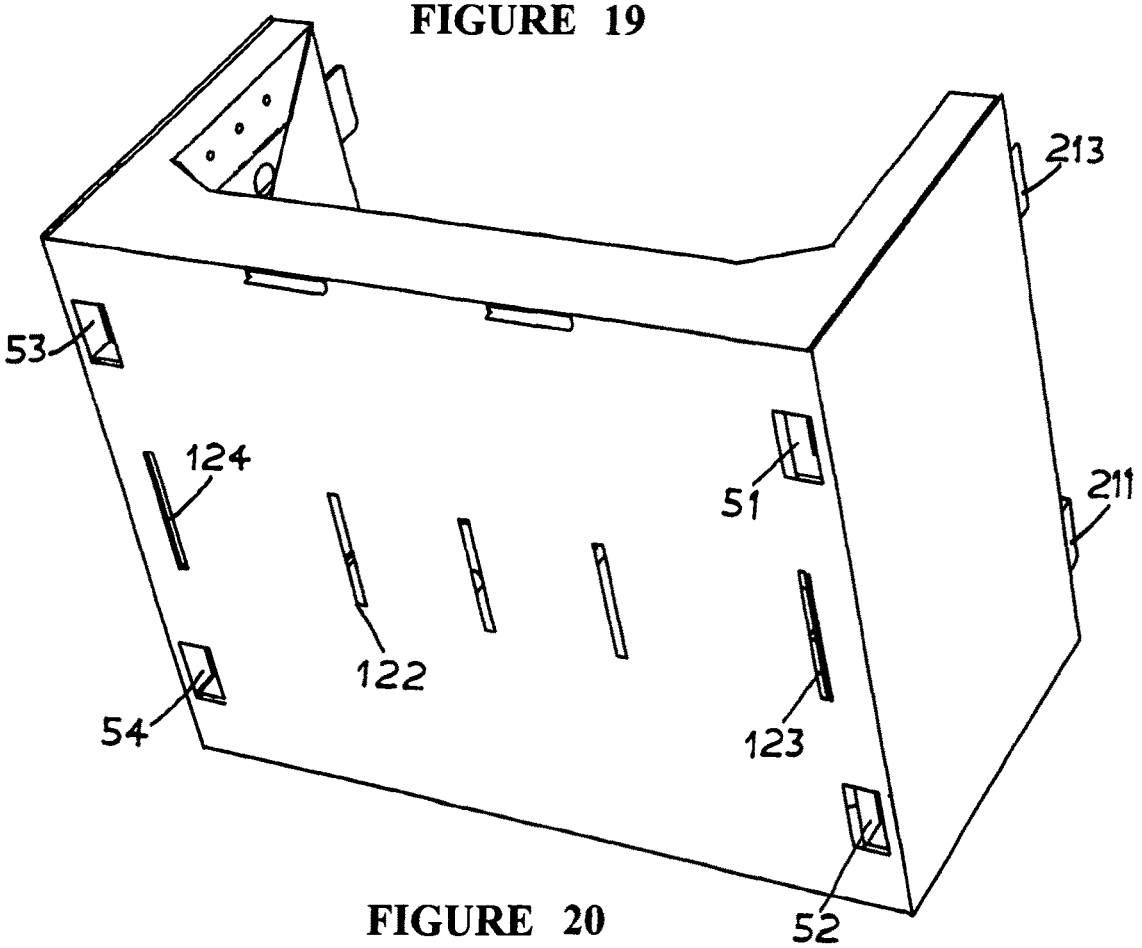
FIG. 20 is a bottom and right front perspective elevation view of the second embodiment.
Figure 21:
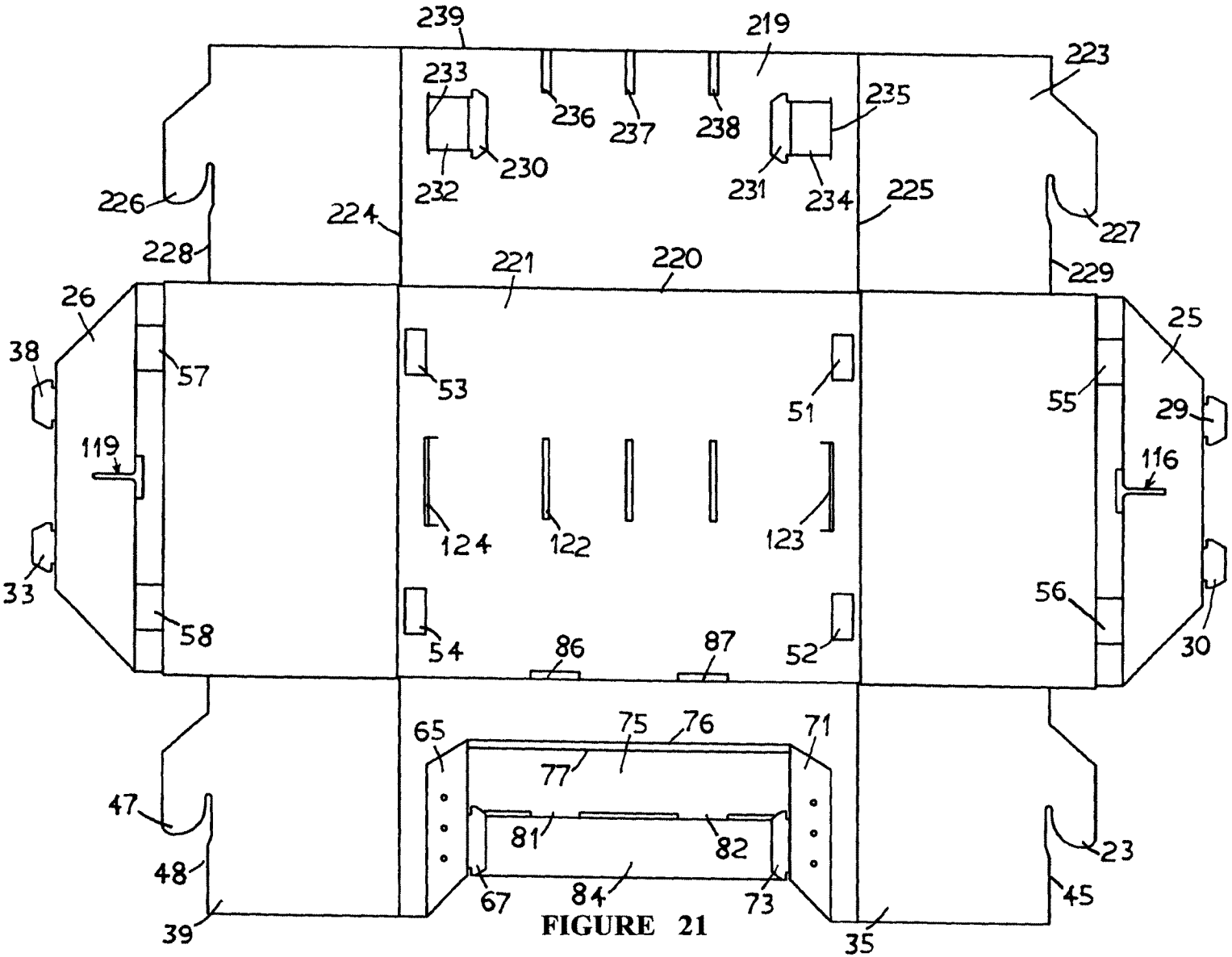
FIG. 21 is a top perspective elevation view of the blank having a geometric pattern for forming the second embodiment of the tray according to the present invention.

A second embodiment of the tray of the present invention the open rear of the tray is replaced by a rear enclosing wall 217 as shown in FIGS. 18 to 20 such that the merchandise in the tray is prevented from falling out of tray through its rear side. The tray of the second embodiment has generally similar construction of the tray 10 of the above embodiment except for inclusion of a rear enclosing wall 217 and it may be fabricated with a blank 218 shown in FIG. 21. A rectangular panel 219 extends upward from the upper edge 220 of the central panel 221. Two latching panels 222 and 223 extend sideway from the vertical left edge 224 and 225 respectively. A hook-shape latch arms 226 and 227 are formed at the outer free edges 228 and 229 respectively. Two latching panels 35 and 39 extend sideway from the front U-shape panel similar to the first embodiment shown above and hook-shape latch arms 23 and 27 are formed at the outer edges 45 and 48 of the latching panels 35 and 39 respectively. Trapezoidal shape mounting tabs 230 and 231 are formed in the upper edge portion of the rectangular panel 219. The left mounting tab 230 has an extension arm 232 connecting it to a vertical fold line 233 which is spaced from the left vertical side edge 224 of the rectangular panel 219 for a distance equal to the thickness of the insert unit 14. Similarly, The right mounting tab 231 has an extension arm 234 connecting it to a vertical fold line 235 which is spaced from the right side edge 223 of the rectangular panel 217 in a distance equal to the thickness of the insert unit 14. The trapezoidal mounting tabs 234 and 235 and their extension arms 232 and 234 can be pushed outward to pivot outward from the rectangular panel 219 with respect to the fold lines 233 and 235 respectively. Three vertical open end slots 236, 237 and 238 are formed at the middle portion of the upper edge 239 of the rectangular panel 219. The open end slots 236, 237 and 238 are spaced from each other in the distances equal to those of the vertical slot openings 122 formed in the central panel of the base unit, and their vertical positions are aligned with those of the vertical slot openings.

Figure 22:
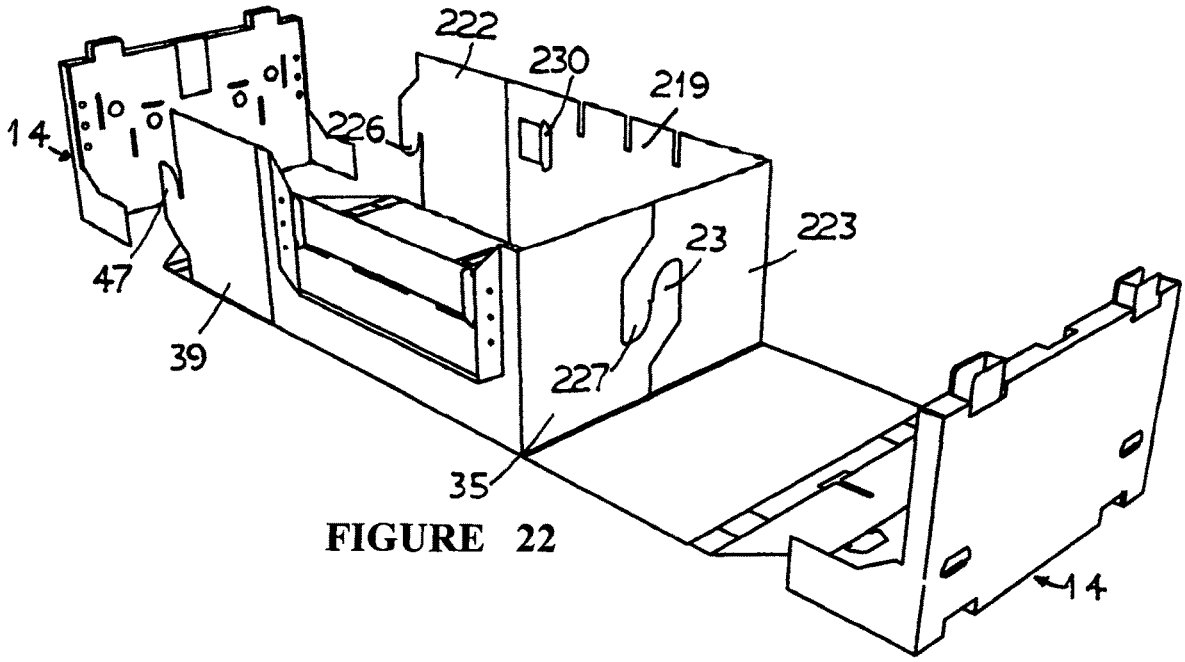
FIG. 22 is a top and right front perspective elevation view showing the formation of the second embodiment from the blank.
Figure 23:
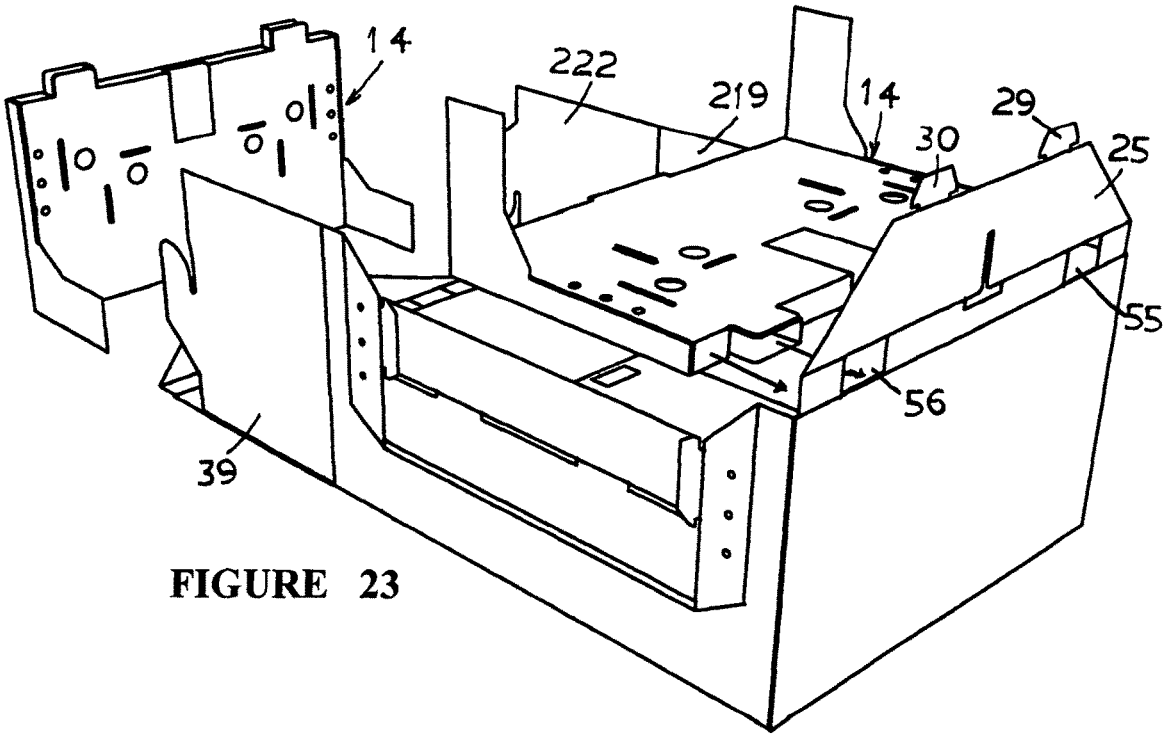
FIG. 23 is a top and right front elevation view showing the positioning of the insert unit in the base unit for formation the second embodiment of the tray according to the present invention.
Figure 24:
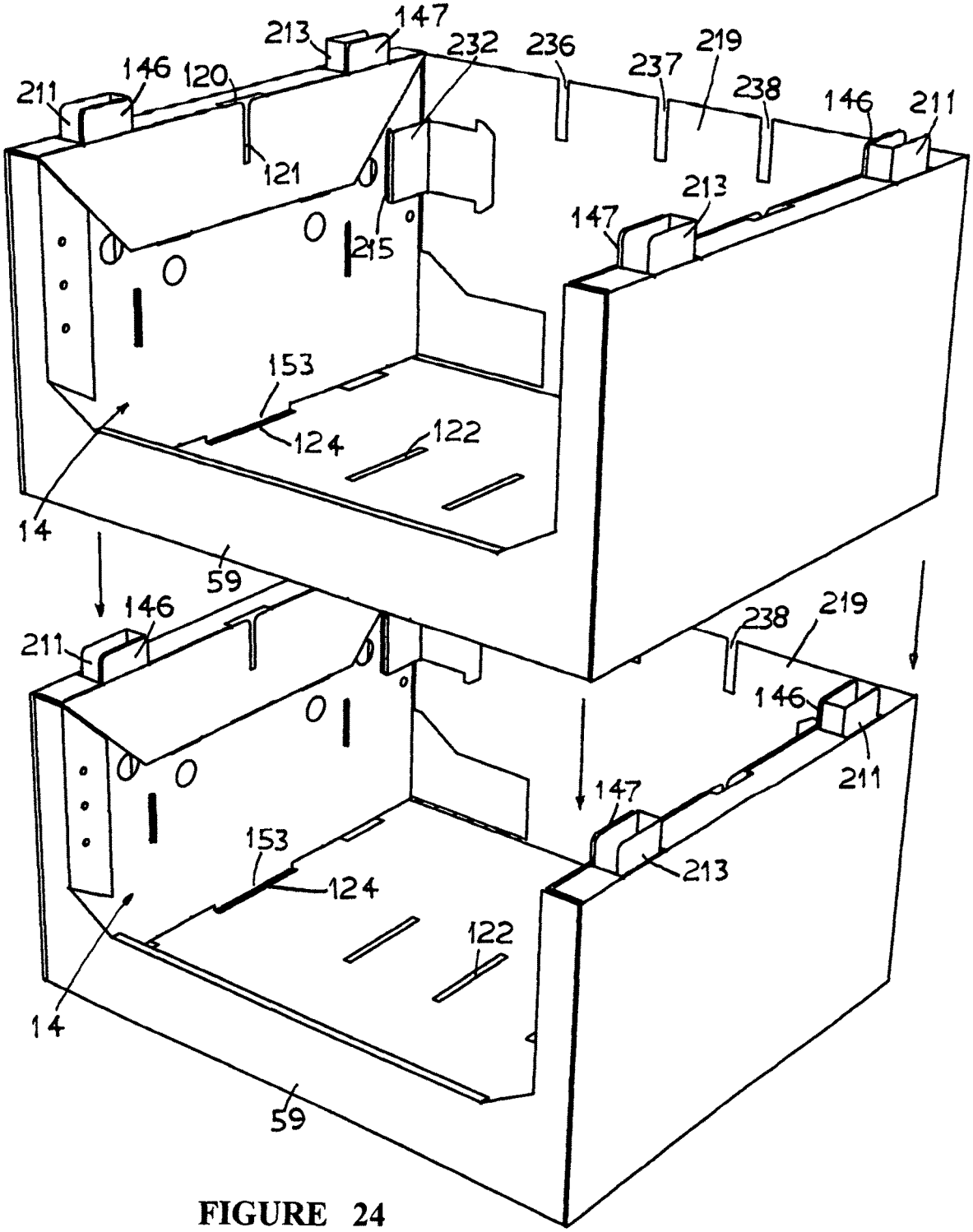
FIG. 24 is a top and right front elevation view showing the positioning of two trays of the second embodiment for stacking one on top of the other.

As shown in FIGS. 22 to 24, the rectangular panel 219 and the front U-shaped panel and latching panels 222 and 223 are folded upward to lie perpendicular to the central panel 219 with the hook-shape latch arms 226 and 227 engage with one another to maintain the rear enclosing panel 219 in the upward folded condition. The front of the tray with the U-shape panel is formed in the same manner as described above so as to form the base unit with the enclosed rear. Insert units 14 are then mounted in the left and right side of the base unit as described in the first embodiment described above. As shown in an exemplary illustration in FIGS. 18 and 19, in the left side of the tray the trapezoidal mounting tab 230 and its extension arm 232 are pivoted to wrap over the right edge of the insert unit. The trapezoidal mounting tab 230 is inserted into the vertical rear mounting slot corresponding to the mounting slot 215 as described in the first embodiment above to mount the insert unit and the rear enclosing panel 219 together.

Figure 25:
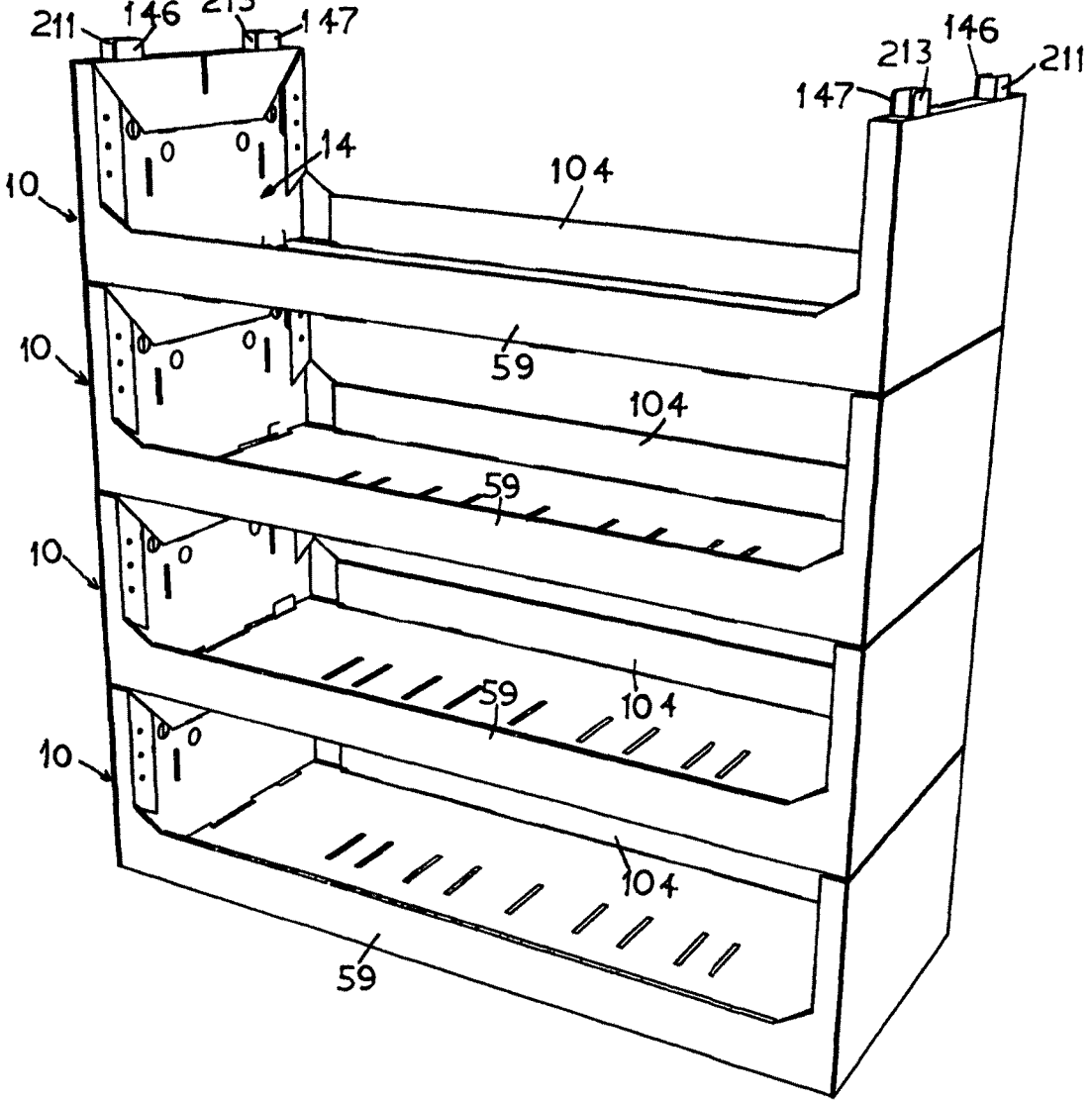
FIG. 25 is a top and right front elevation view showing a stack of trays with open front and rear according to the present invention having a long base unit.
Figure 26:
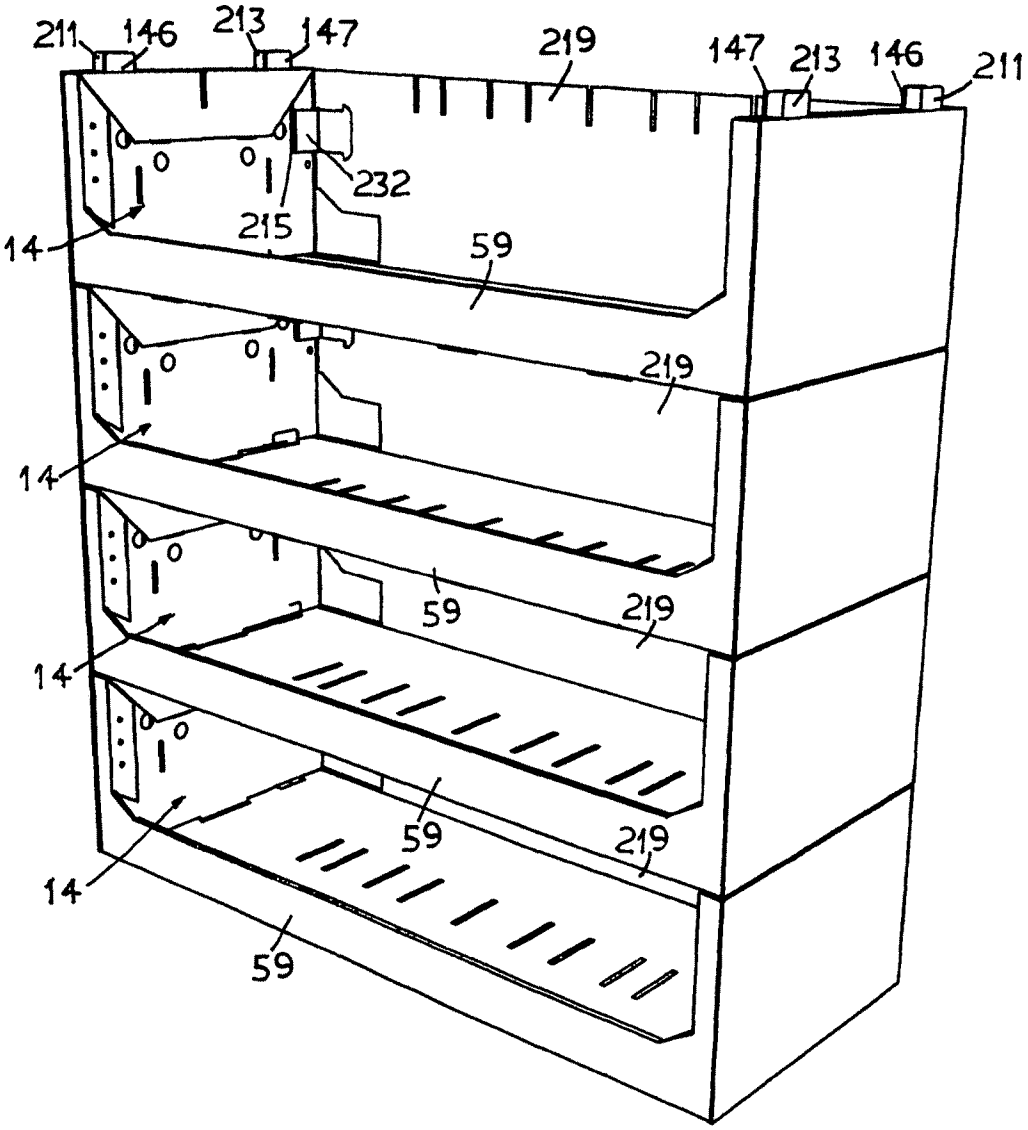
FIG. 26 is a top and right front elevation view showing a stack of trays of the second embodiment with open front and an enclosed rear wall.

As shown in FIGS. 25 and 26, a plurality of trays with open front and rear, and trays with open front and enclosed rear, according to the present invention, having a wide base unit may be stacked together. The wide trays are formed in the modular fashion with the same insert units with the first and second embodiments of the trays shown above.

The U-shaped mounting tabs together with the reinforcing rectangular panels provide very strong mounting between trays stacked together and they provide high resistance to lateral force exerted on the stack. Furthermore, the position of the mounting tabs spaced from the corners of the tray would disperse and dissipate any vertical force exerted on the stack to the entire side panel of the trays whereas in known merchandise trays the mounting tabs are located at the corners of the top edge such that any external vertical force exerted on the trays in a stack would be concentrated along the vertical direction of the corner edges of the trays to cause distortion in weak pressure points at the corners of the tray.

Figure 27B:
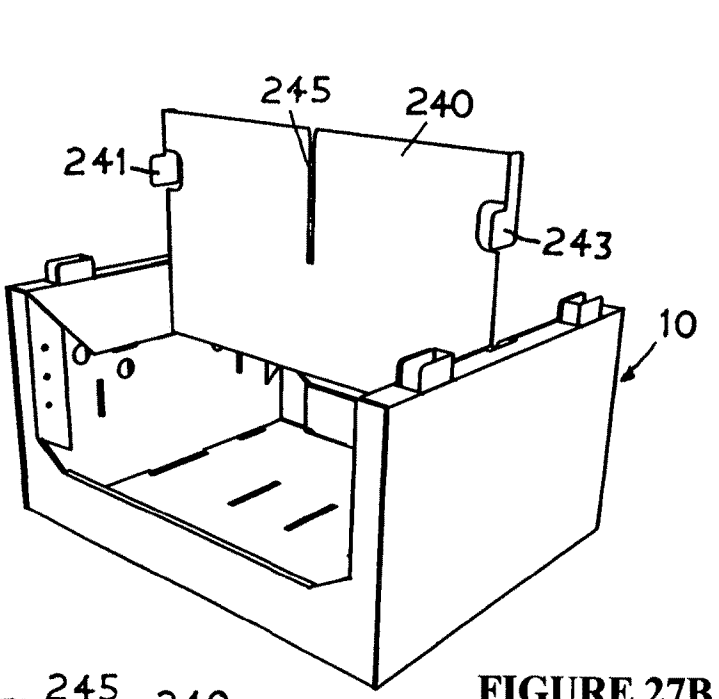
FIGS. 27A, 27B and 27C are top and right front elevation views showing the mounting of a longitudinal divider in the tray for separating the tray interior into a front compartment and a rear compartment.
Figure 27C:
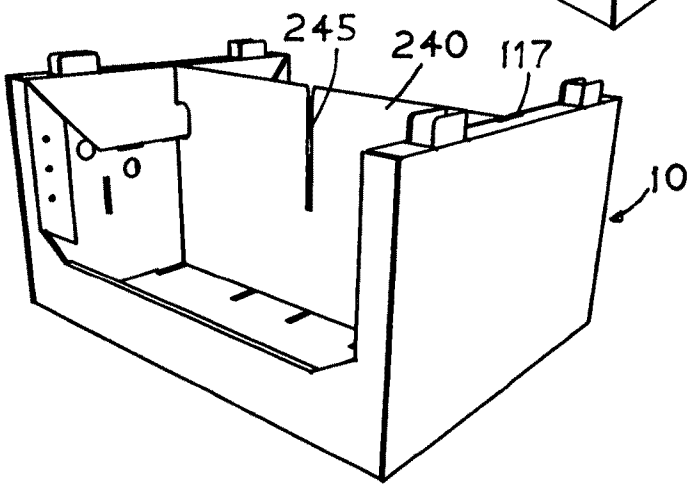
Figure 27A:
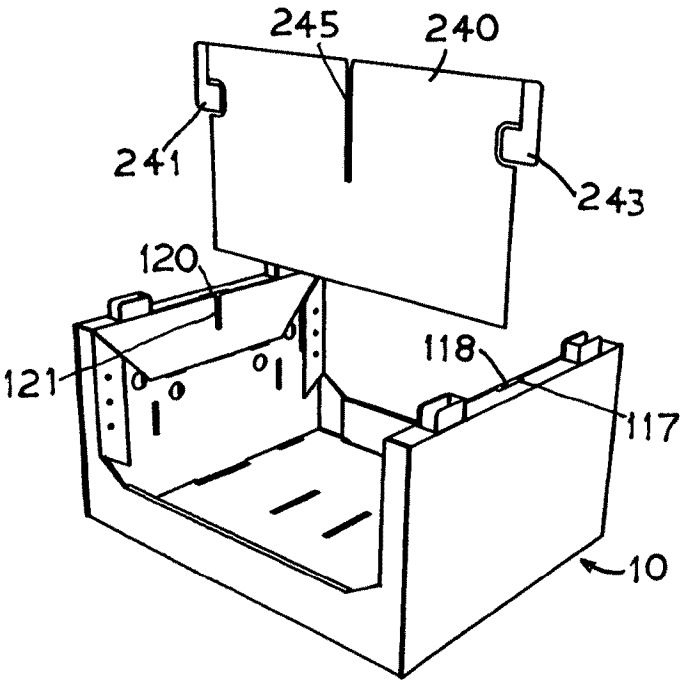
Figure 28B:
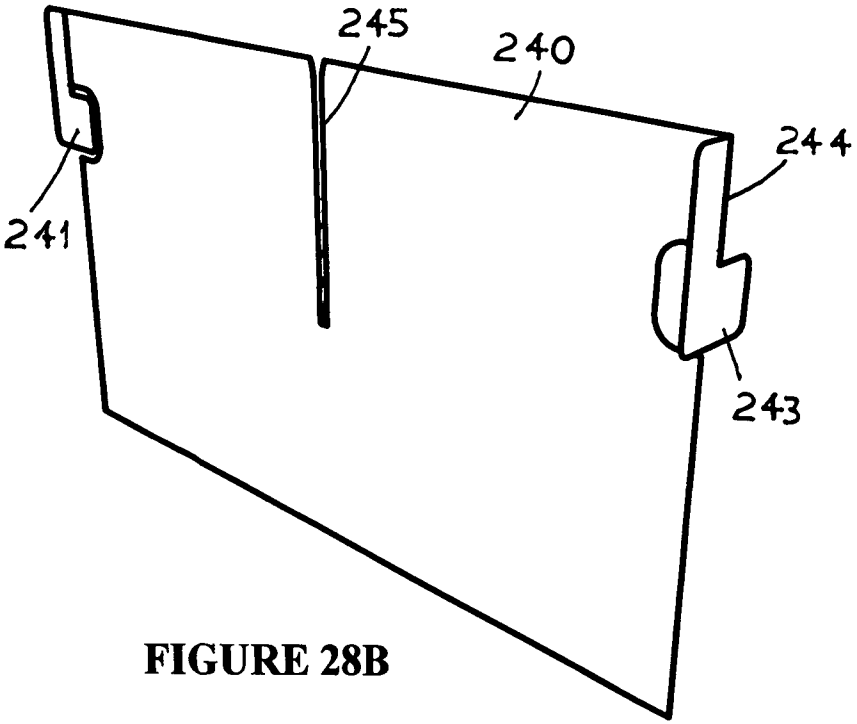
FIGS. 28A and 28B are front perspective elevation views showing the longitudinal divider in an initial flat condition and in a second condition with the side latching arm folded outward sideway to position perpendicular to the main surface of the divider.
Figure 28A:
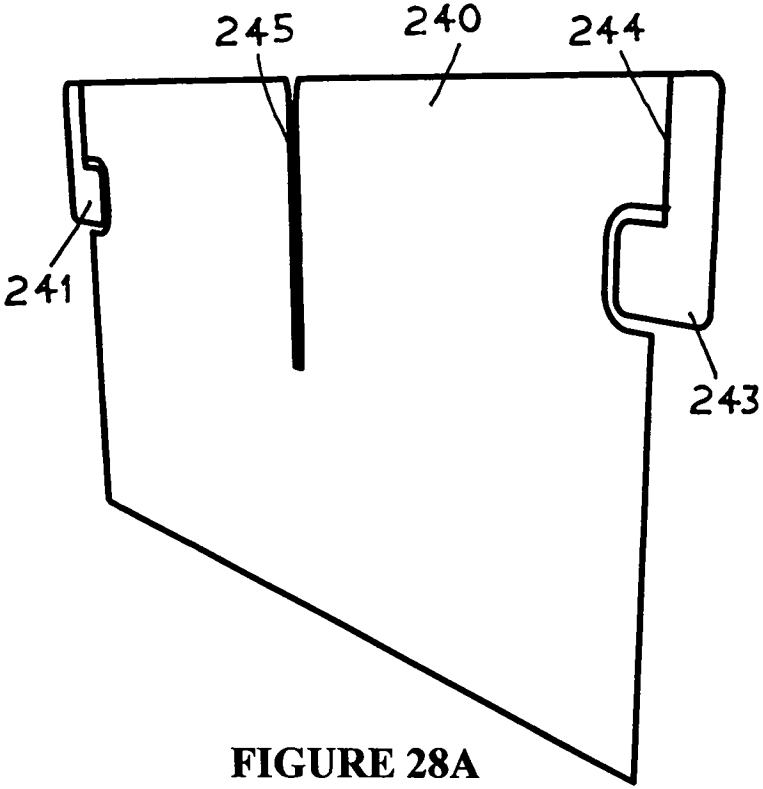
Figure 30B:
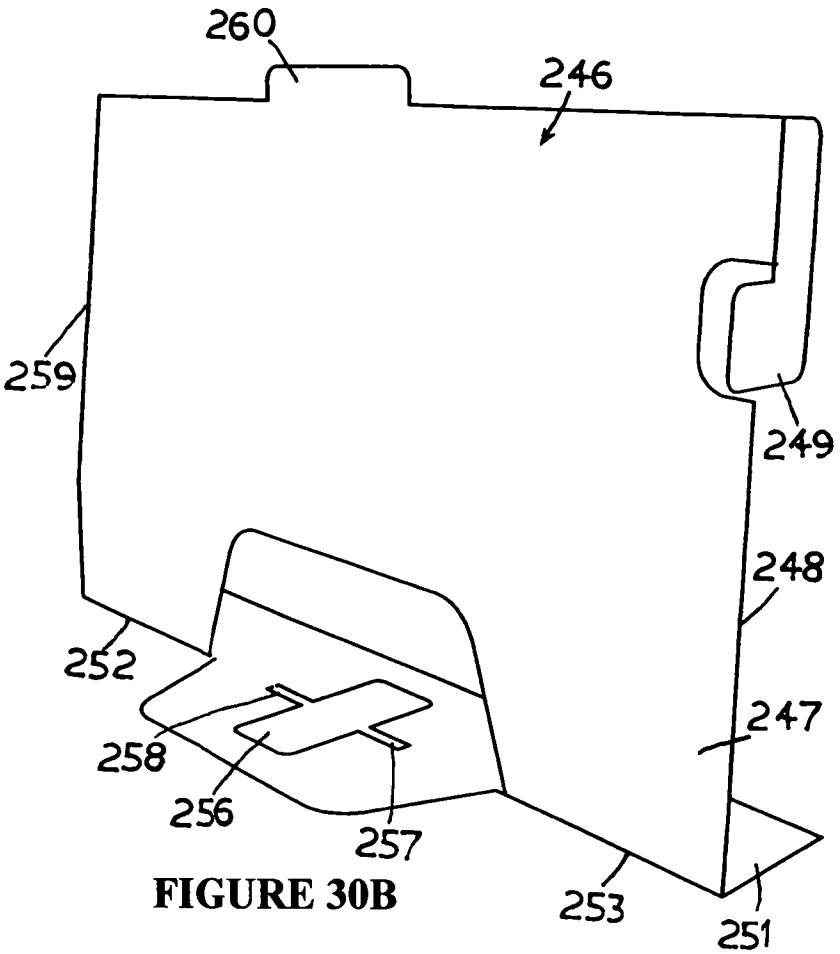
FIGS. 30A and 30B are front perspective elevation views showing the transverse divider in an initial flat condition and in a second condition with a folded base and a latching arm folded to lie perpendicular to the surface of the transverse divider.
Figure 30A:
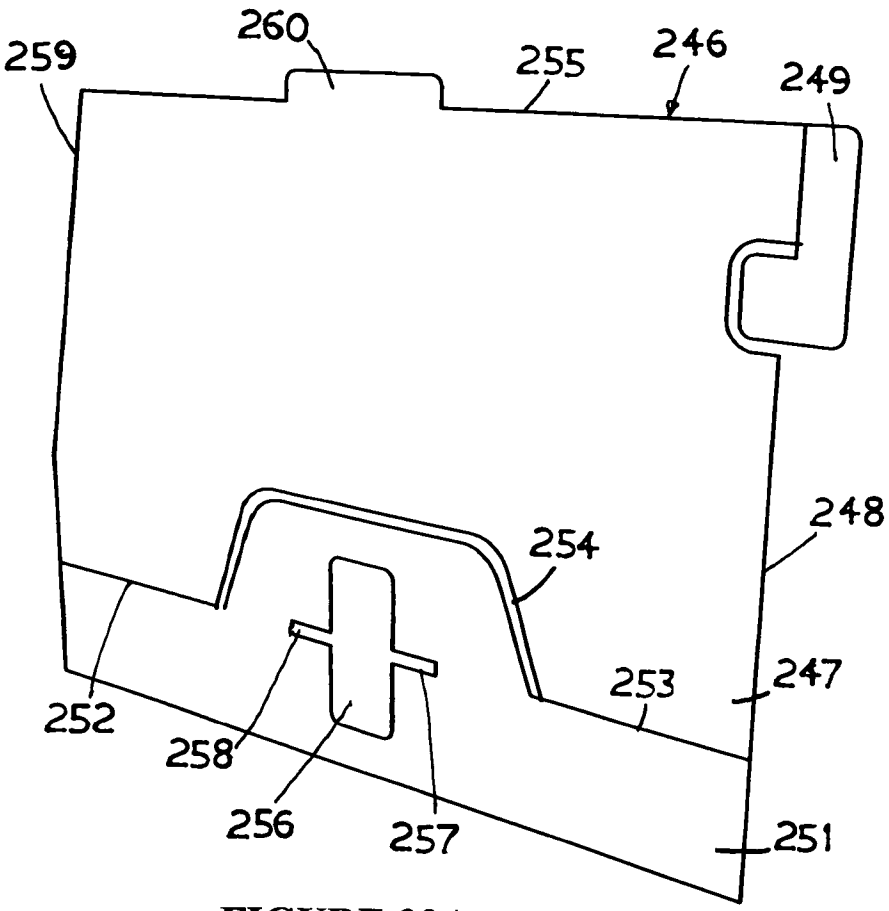

It is apparent from the above description, the rugged tray of the present invention may be readily assembled without use of adhesive, As best shown in FIGS. 27A through 27C, a longitudinal divider 240 may be mounted in the tray for separating the interior of the tray 10 into a front compartment and a rear compartment. Such longitudinal divider is particularly useful for the tray with the open front and rear for separating two different merchandise items from one another. As shown in the FIG. 28A, the longitudinal divider 240 is formed with a rectangular corrugated board having a length equal to the interior width of the tray between the left and the right insert units, and a height equal to the height of the insert unit. An L-shaped left mounting arm 241 extends outward from a fold line 242 located at the top left side edge portion of the board, similarly a reverse L-shaped right mounting arm 243 is formed at the right top side edge portion of the board and extending outward from a fold line 244. As best shown in FIGS. 27A through 27C, the longitudinal divider 249 may be mounted to the tray 10 by first folding the left mounting arm 241 and the right mounting arm 243 sideway outward to lie perpendicular to the main surface of the board, and the divider is then inserted downward into the tray with the left mounting arm 241 engaging with the top slot 120 of the left insert unit, and the right mounting arm 243 engaging with the top slot 117 of the right insert unit. The longitudinal divider 240 is then inserted downward with the mounting arms slidably engaging with the vertical slots 121 and 118 of the left insert unit and the right insert unit respectively until the divider is fully inserted into the tray with the longitudinal divider rigidly mounted in place by the co-operation of the mounting arms with the slots 118 and 121 of the insert units and the remaining lower side edges of the longitudinal divider frictionally engaged with the surface of the insert units, and the bottom edge of the longitudinal divider engaging with the bottom panel 16 of the tray. The longitudinal divider 240 also provides additional reinforcement to strengthen the rigidity of the tray. An open-end vertical slot 245 is formed at the middle of the longitudinal divider 240 such that an additional board (not shown), if required, may be inserted into the tray for further dividing the interior of tray into four separate compartments.

As best shown in FIGS. 29A through 29C at least one transverse divider 246 may be provided in the tray for dividing the interior of the tray into two or more side by side compartments. The transverse divider 246 is particularly useful for the tray having the closed rear wall 219. The transverse divider 246 is formed by a generally rectangular corrugated board 247 having a vertical rear edge 248. The width of the transverse divider 246 is equal to the interior transverse width of the tray between the inner surface of the U-shaped front panel 59 and the inside surface of the rear enclosing panel 219. A reverse L-shaped arm 249 is formed at the upper edge portion of the rear edge of the board 247 with the upper portion of the reverse L-shaped arm 249 extending outward from the upper edge fold line 250. A generally reverse T-shape portion 251 extends downward from the board 247. The T-shaped panel 251 is connected to the board 247 by front bottom fold line 252 and rear bottom fold line 253. The middle portion of the T-shaped panel 251 has a generally trapezoidal shape and it is separated from a reverse U-shaped middle portion 254 of the fold line 252. The length of the fold line 252 is equal to the width of the tray between the inner surface of the inverted U-shape front panel 59 and the inner surface of the rear enclosing panel 219, and the height between the fold line 252 and the upper edge 255 of the board 247 is equal to the height of the insert unit which is the height of the tray. A rectangular opening 256 is formed at the middle of the T-shaped panel 251. Two side slots 257 and 258 extends sideway from the middle of the side edges of the rectangular opening 256. The combined total length of the two side slots 257 and 258 is equal to the length of the transverse slot opening 122 formed at the bottom panel of the tray. The upper front edge portion 259 may be skewed slightly backwards for aesthetic purposes A rectangular tab 260 is formed at the middle of the upper edge of the transverse divider. The length of the rectangular tab 260 is equal to the length of the transverse slot opening 122 formed at the bottom panel of the tray.

As best shown in FIGS. 29A through 29C, the transverse divider 246 is mounted in the tray by first bending the reverse L-shaped arm 249 sideway to lie perpendicular to the surface of the divider. The T-shaped panel is folded sideway until it lies perpendicular to the surface of the divider. The transverse divider 246 is then inserted into the tray by engaging the reverse L-shaped arm 249 with selected one of the open end slots 236, 237, and 238 formed at the upper edge of the rear enclose panel 219. The transverse divider 246 is continue to insert downward until the T-shaped panel lies contiguous to the bottom panel of the tray, and the rear edge 248 and the front bottom edge frictionally engaged with the inner surface of the front panel 59 and inner surface of the rear enclose panel 219 of the tray so that the transverse divider 246 is firmly mounted in place within the tray The side slots 257 and 258 will be aligned with the transverse slot opening 122 so that when two or more trays are stacked together, the rectangular tab 260 of a lower tray will extend through the transverse open slot 122 of the tray on top.

What is claimed is:

1. A stackable merchandise tray comprising, a rectangular base casing having a bottom panel and a left lateral side panel extending perpendicularly upward from a left side of said bottom panel and a right lateral side panel extending perpendicularly upward from a right side of said bottom panel, a rectangular insert unit mounted within each said left side and said right side of said base casing and located contiguous to an inside surface of said left lateral side panel and said right lateral side panel respectively, each of said left lateral side panel and said right lateral side panel having a middle portion folded and covering over on top of each said insert unit located at the left side and the right side of said base casing to form a left side top panel and a right side top panel of said tray respectively, and an end portion of said left lateral side panel being folded to cover over a top portion of an inside surface of said insert unit located at said left side of said base casing and similarly an end portion of said right lateral side panel being folded to cover aver a top portion of an inside surface of said insert unit located at said right side of said base casing two vertically upstanding U-shaped mounting tabs located at said left side top panel and said right side top panel, said U-shaped mounting tabs having a U-shaped top edge and being located spaced from side corners of said left side top panel and said right side top panel, four rectangular mounting openings formed in said bottom panel of said base unit, said mounting openings being aligned to vertical positions of said U-shaped mounting tabs.

2. A stackable tray according to claim 1 wherein said U-shaped mounting tabs extend upward through two rectangular openings formed in both said left side top panel and right side top panel of said base casing.

3. A stackable merchandise tray according to claim 2 wherein each of said left lateral side panel and said right lateral side panel includes two foldable vertical side panels extending sideway from side edges therein, said foldable vertical side panels being foldable over side edge portions of said insert unit located at both left side and right side of said base casing.

4. A stackable merchandise tray according to claim 3 wherein said foldable panels have a vertical mounting tab located at a vertical free outer edge of said foldable panels, said vertical mounting tabs being engageable with vertical mounting slots formed at an inner surface of said insert unit for mounting said insert unit securely within said base casing.

5. A stackable merchandise tray according to claim 4 wherein said base casing bac an open front and an enclosed rear, said open front having a U-shaped panel, and said U-shaped panel having a transverse middle portion extending between two upstanding side panels, a three-layer panel formed at said transverse middle portion by three double folded transverse panels, said three-layer panel also wrapping over an end portion of said horizontal leg of said L-shaped panel at said front, a rectangular rear panel extending perpendicular to said bottom panel of said base casing and covering the rear of said base casing.

6. A stackable merchandise tray according to claim 5 including at least one transverse divider mounted in a transverse manner between said front U-shaped panel and said rear panel, said transverse divider having an L-shaped mounting arm formed at an upper vertical rear edge and extending sideway perpendicular to said transverse divider, a T-shaped panel located at a bottom end of said transverse divider and extending perpendicular to said transverse divider, said transverse divider being mountable within said tray with said L-shaped mounting arm slidably engaging with a selected open end slot located at a top edge of said rear panel, and said T-shaped panel abutting said bottom panel of said tray.

7. A stackable merchandise tray according to claim 6 including a rectangular opening formed at the middle of said T-shaped panel, two open end slots formed at two opposite sides of said rectangular opening, said two open end slots being aligned with transverse mounting slots formed at the bottom panel of said tray.

8. A stackable tray according to claim 3 wherein said insert unit has two L-shaped side panels extending perpendicular to said rectangular inner panel and said outer rectangular main panel, said L-shaped side panels having a horizontal leg with a bottom edge abutting said bottom panel of said base casing.

9. A stackable merchandise tray according to claim 8 wherein base casing has an open front and an open rear, each of said open front and said open rear having a U-shaped panel, and said U-shaped panel having a transverse middle portion extending between two upstanding side panels, a composite three-layer panel formed at said transverse middle portion by tree folded transverse panels, said composite three-layer panel also wrapping over an end portion of said horizontal leg of said L-shaped side panels of said insert unit to provide additional mounting of said insert unit fixedly in place within said base casing.

10. A stackable merchandise tray according to claim 9 wherein said U-shaped mounting tabs have an open side facing sideway toward a side edge of said left side top panel and said right side top panel of said base casing top panel of said left lateral side panel and said right lateral side panel.

11. A stackable merchandise tray according to claim 10 including two foldable vertical mounting tabs formed in vertical side edges of said rectangular rear panel and located adjacent to said insert unit mounted at said left side and said right side of said base casing, said two foldable vertical mounting tabs engaging with a vertical mounting slot formed in said inner panel of said insert unit mounted in said left side and said right side of said base casing.

12. A stackable merchandise tray according to claim 10 including a rectangular longitudinal divider mounted within said tray and extending between an inner surface of insert units mounted at left side and right side of said tray to form a front compartment and a rear compartment within said tray, said longitudinal divider having a left L-shaped mounting arm located at a top edge of a left side edge and extending perpendicular to said divider, and a right reverse L-shaped mounting arm located at a top edge of a right side edge and extending perpendicular to said divider, said left L-shaped mounting arm being slidably engageable with a T-shaped slot formed at the middle of the top panel wrapping over the insert unit located at the left side of said tray, and said reverse L-shaped mounting arm being slidably engageabale with a similar T-shaped slot formed at the middle of the top panel wrapping over the insert unit located at the right side of said tray, and a bottom edge of said longitudinal divider being abutting to the bottom panel of said tray.

13. A stackable merchandise tray according to claim 2 wherein said insert unit includes two box-like rectangular case units sandwiched between a rectangular inner panel and an outer rectangular main panel, said rectangular case units being formed by double folding a side panel extending at a side edge of said inner panel, a middle panel extending sideway from said side panel, an abutment panel extending sideway of said middle panel, and an end panel extending sideway from said middle panel, and said U-shaped mounting tabs being formed by rectangular extension portions located at top edges of said double folded middle panel, said abutment panel and said end panel, said reinforcing tabs being rectangular extension portions formed at a top edge of said inner panel.

14. A stackable merchandise tray comprising, a rectangular base casing having a bottom panel and a left lateral side panel extending perpendicularly upward from a left said of said bottom panel and a right lateral side panel extending perpendicularly upward from a right side of said bottom panel, a rectangular insert unit mounted within each said left side and said right side of said base casing and located contiguous to an inside surface of said left lateral side panel and said right lateral side panel, two hollow box-like columns located in a vertical manner within said insert unit.

two upstanding U-shaped mounting tabs extending vertically upward at a top panel of each said left lateral side panel and said right lateral side panel, said U-shaped mounting tabs being located spaced from side corners of said top panel, said top panel of each said left lateral side panel and said right lateral side panel having an extension panel covering over and mounted to a top portion of an inner surface of said insert unit located at said left side and said right side of said base casing, two rectangular reinforcing tabs extending upward of said insert unit and located contiguous to a vertical side of said horizontal U-shaped mounting tabs, a generally U-shaped front panel extending vertically upward at an open front of said tray and front panel having a transverse middle portion extending between two vertically upstanding side panels, a composite three-layer panel formed at said transverse middle portion, four rectangular mounting opening formed in said bottom panel of said base unit, said mounting openings being aligned to vertical positions of said U-shaped mounting tabs.

* * * * *